US012578124B2

(12) United States Patent
Brown

(10) Patent No.: US 12,578,124 B2
(45) Date of Patent: Mar. 17, 2026

(54) INTEGRATED DEMAND WATER HEATING USING A CAPACITY MODULATED HEAT PUMP WITH DESUPERHEATER

(71) Applicant: WaterFurnace International, Inc., Fort Wayne, IN (US)

(72) Inventor: Robert R. Brown, Markle, IN (US)

(73) Assignee: WaterFurnace International, Inc., Fort Wayne, IN (US)

( * ) Notice: Subject to any disclaimer, the term of this patent is extended or adjusted under 35 U.S.C. 154(b) by 0 days.

(21) Appl. No.: 18/628,070

(22) Filed: Apr. 5, 2024

(65) Prior Publication Data

US 2024/0247841 A1 Jul. 25, 2024

Related U.S. Application Data

(63) Continuation of application No. 18/175,203, filed on Feb. 27, 2023, now Pat. No. 11,953,239, which is a (Continued)

(51) Int. Cl.
*F25B 30/02* (2006.01)
*F24H 4/02* (2022.01)

(Continued)

(52) U.S. Cl.
CPC ..... *F25B 13/00* (2013.01); *F25B 29/003* (2013.01); *F25B 30/02* (2013.01); *F25B 40/04* (2013.01);

(Continued)

(58) Field of Classification Search
CPC ..... F25B 39/02; F25B 39/04; F25B 40/04; F25B 30/02; F25B 29/003; F25B 41/35
See application file for complete search history.

(56) References Cited

U.S. PATENT DOCUMENTS 1,723,649 A 8/1929 Earl
2,486,908 A 11/1949 Andersson (Continued)

FOREIGN PATENT DOCUMENTS

AU 2013200092 4/2013
CA 1178268 11/1984

(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).

(Continued)

*Primary Examiner* — Nelson J Nieves
(74) *Attorney, Agent, or Firm* — Crowell & Moring LLP; Thomas E. Williams

(57) ABSTRACT

A heat pump system provides at least six modes of heating, cooling, and/or domestic water heating operation, where domestic water heating may occur concurrently with heating or cooling a space in a structure. The heat pump system comprises a desuperheater positioned downstream of the compressor and operable as a desuperheater, a condenser or an evaporator, a source heat exchanger operable as either a condenser or an evaporator, a load heat exchanger operable as either a condenser or an evaporator, a reversing valve positioned downstream of the desuperheater heat exchanger and configured to alternately direct refrigerant flow from the desuperheater heat exchanger to one of the load heat exchanger and the source heat exchanger and to alternately return refrigerant flow from the other of the load heat exchanger and the source heat exchanger to the compressor, (Continued)

and an expansion valve positioned between the load heat exchanger and the source heat exchanger.

13 Claims, 8 Drawing Sheets

Related U.S. Application Data continuation of application No. 16/539,956, filed on Aug. 13, 2019, now Pat. No. 11,592,215.

(60) Provisional application No. 62/724,459, filed on Aug. 29, 2018.

(51) Int. Cl.

| | |
|---|---|
| ***F25B 13/00*** | (2006.01) |
| ***F25B 29/00*** | (2006.01) |
| ***F25B 40/04*** | (2006.01) |
| ***F25B 41/35*** | (2021.01) |
| *F25B 39/02* | (2006.01) |
| *F25B 39/04* | (2006.01) |

(52) U.S. Cl.

CPC ..... *F25B 41/35* (2021.01); *F24H 4/02* (2013.01); *F25B 39/02* (2013.01); *F25B 39/04* (2013.01)

(56) References Cited

U.S. PATENT DOCUMENTS 2,545,054 A 3/1951 Stitz
2,822,136 A 2/1958 Dalin
3,069,867 A 12/1962 Ringquist
3,127,928 A 4/1964 Ringquist
3,127,929 A 4/1964 Ringquist
3,252,504 A 5/1966 Newton
3,303,873 A 2/1967 Ringquist et al.
3,307,368 A 3/1967 Harnish
3,354,774 A 11/1967 Smitzer et al.
3,378,062 A 4/1968 Ringquist et al.
3,460,353 A 8/1969 Ogata et al.
3,671,404 A 6/1972 Meckler
3,685,574 A 8/1972 Worms
3,693,704 A 9/1972 Newton
3,734,169 A 5/1973 Falk
3,857,253 A 12/1974 Burgett et al.
3,916,638 A 11/1975 Schmidt
3,938,352 A 2/1976 Schmidt
3,995,809 A 12/1976 Karlsson
4,000,850 A 1/1977 Diggs
4,030,312 A 6/1977 Wallin et al.
4,065,938 A 1/1978 Jonsson
4,072,187 A 2/1978 Lodge
4,091,636 A 5/1978 Margen
4,122,892 A 10/1978 Delaporte
4,129,013 A 12/1978 Hine, Jr.
4,141,407 A 2/1979 Briscoe et al.
4,144,999 A 3/1979 Zebuhr
4,148,436 A 4/1979 Shaw
4,173,865 A 11/1979 Sawyer
4,179,894 A 12/1979 Hughes
4,257,239 A 3/1981 Partin et al.
4,299,098 A 11/1981 Derosier
4,346,565 A 8/1982 McCarty
4,353,410 A 10/1982 Godard
4,353,412 A 10/1982 Krumhansl
4,363,221 A 12/1982 Singh
4,380,156 A 4/1983 Ecker
4,399,664 A 8/1983 Derosier
4,402,910 A 9/1983 Smith et al.
4,441,901 A 4/1984 Endoh
4,448,040 A 5/1984 Kunugi
4,454,725 A 6/1984 Cann
4,474,232 A 10/1984 Wright et al.
4,476,920 A 10/1984 Drucker et al.
4,493,193 A 1/1985 Fisher
4,514,989 A 5/1985 Mount
4,528,822 A 7/1985 Glamm
4,531,374 A 7/1985 Alefeld
4,538,418 A 9/1985 Lawrence et al.
4,559,788 A 12/1985 McFarlan
4,575,001 A 3/1986 Oskarsson et al.
4,584,844 A 4/1986 Lemal
4,592,206 A 6/1986 Yamazaki et al.
4,598,557 A 7/1986 Robinson et al.
4,645,908 A 2/1987 Jones
4,646,537 A 3/1987 Crawford
4,646,538 A 3/1987 Blackshaw et al.
4,678,025 A 7/1987 Oberlander et al.
4,685,307 A 8/1987 Jones
4,693,089 A 9/1987 Bourne et al.
4,698,978 A 10/1987 Jones
4,699,122 A 10/1987 Jannemann et al.
4,727,727 A 3/1988 Reedy
4,766,734 A 8/1988 Dudley
4,776,180 A 10/1988 Patton, Sr. et al.
4,796,437 A 1/1989 James
4,798,059 A 1/1989 Morita
4,798,240 A 1/1989 Gerstmann et al.
4,799,005 A 1/1989 Fernandes
4,799,363 A 1/1989 Nakamura
4,835,976 A 6/1989 Torrence
4,852,362 A 8/1989 Conry
4,856,578 A 8/1989 Mccahill
4,874,040 A 10/1989 Herrmann
4,884,021 A 11/1989 Hammond et al.
4,893,476 A 1/1990 Bos et al.
4,895,005 A 1/1990 Norbeck et al.
4,909,041 A 3/1990 Jones
4,909,312 A 3/1990 Biedenbach et al.
4,920,757 A 5/1990 Gazes et al.
4,924,681 A 5/1990 Devit et al.
4,938,032 A 7/1990 Mudford
4,989,670 A 2/1991 Foley
5,038,580 A 8/1991 Hart
5,044,425 A 9/1991 Tatsumi et al.
5,070,704 A 12/1991 Conry
5,074,464 A 12/1991 Moore, Jr.
5,081,848 A 1/1992 Rawlings et al.
5,088,296 A 2/1992 Hamaoka
5,099,651 A 3/1992 Fischer
5,105,629 A 4/1992 Parris et al.
5,136,855 A 8/1992 Lenarduzzi
5,172,564 A 12/1992 Reedy
5,187,944 A 2/1993 Jarosch
5,224,357 A 7/1993 Galiyano et al.
5,237,826 A 8/1993 Baldwin et al.
5,239,838 A 8/1993 Tressler
5,269,153 A 12/1993 Cawley
5,289,362 A 2/1994 Liebl et al.
5,305,822 A 4/1994 Kogetsu et al.
5,309,732 A 5/1994 Sami
5,323,844 A 6/1994 Sumitani et al.
5,339,890 A 8/1994 Rawlings
5,351,504 A 10/1994 Giacometti
5,354,268 A 10/1994 Peterson et al.
5,355,688 A 10/1994 Rafalovich et al.
5,372,016 A 12/1994 Rawlings
5,395,524 A 3/1995 Sugg
5,438,846 A 8/1995 Datta
5,461,876 A 10/1995 Dressler
5,463,619 A 10/1995 Van et al.
5,465,588 A 11/1995 Mccahill et al.
5,475,986 A 12/1995 Bahel et al.
5,477,914 A 12/1995 Rawlings
5,497,629 A 3/1996 Rafalovich et al.
5,507,337 A 4/1996 Rafalovich et al.
5,533,355 A 7/1996 Rawlings
5,564,282 A 10/1996 Kaye
5,613,372 A 3/1997 Beal et al.
5,619,864 A 4/1997 Reedy
5,622,057 A 4/1997 Bussjager et al.

(56) References Cited

U.S. PATENT DOCUMENTS

| | | | |
|---|---|---|---|
| 5,628,200 | A | 5/1997 | Pendergrass |
| 5,651,265 | A | 7/1997 | Grenier |
| 5,660,050 | A | 8/1997 | Wilson et al. |
| 5,660,201 | A | 8/1997 | Turner |
| 5,669,224 | A | 9/1997 | Lenarduzzi |
| 5,678,626 | A | 10/1997 | Gilles |
| 5,689,966 | A | 11/1997 | Zess et al. |
| 5,701,750 | A | 12/1997 | Ray |
| 5,706,888 | A | 1/1998 | Ambs et al. |
| 5,711,155 | A | 1/1998 | DeVilbiss et al. |
| 5,729,985 | A | 3/1998 | Yoshihara et al. |
| 5,743,110 | A | 4/1998 | Laude-Bousquet |
| 5,755,104 | A | 5/1998 | Rafalovich et al. |
| 5,758,514 | A | 6/1998 | Genung et al. |
| 5,802,864 | A | 9/1998 | Yarbrough et al. |
| 5,806,331 | A | 9/1998 | Brown |
| 5,816,065 | A | 10/1998 | Maeda |
| 5,927,088 | A | 7/1999 | Shaw |
| 5,927,096 | A | 7/1999 | Piccione |
| 5,937,665 | A | 8/1999 | Kiessel et al. |
| 5,946,926 | A | 9/1999 | Hartman |
| 5,953,926 | A | 9/1999 | Dressler et al. |
| 5,983,660 | A | 11/1999 | Kiessel et al. |
| 5,987,908 | A | 11/1999 | Wetzel |
| 5,992,160 | A | 11/1999 | Bussjager et al. |
| 6,000,154 | A | 12/1999 | Berard et al. |
| 6,016,629 | A | 1/2000 | Sylvester et al. |
| 6,032,472 | A | 3/2000 | Heinrichs et al. |
| 6,041,613 | A | 3/2000 | Morse et al. |
| 6,070,423 | A | 6/2000 | Hebert |
| 6,082,125 | A | 7/2000 | Savtchenko |
| 6,098,657 | A | 8/2000 | Sugg |
| 6,123,147 | A | 9/2000 | Pittman |
| 6,149,066 | A | 11/2000 | Perry et al. |
| 6,167,715 | B1 | 1/2001 | Hebert |
| 6,212,892 | B1 | 4/2001 | Rafalovich |
| 6,227,003 | B1 | 5/2001 | Smolinsky |
| 6,253,564 | B1 | 7/2001 | Yarbrough et al. |
| 6,260,374 | B1 | 7/2001 | Smith et al. |
| 6,298,677 | B1 | 10/2001 | Bujak, Jr. |
| 6,347,527 | B1 | 2/2002 | Bailey et al. |
| 6,385,510 | B1 | 5/2002 | Hoog et al. |
| 6,385,983 | B1 | 5/2002 | Sakki et al. |
| 6,418,745 | B1 | 7/2002 | Ratliff |
| 6,434,960 | B1 | 8/2002 | Rousseau |
| 6,442,951 | B1 | 9/2002 | Maeda et al. |
| 6,467,279 | B1 | 10/2002 | Backman et al. |
| 6,470,679 | B1 | 10/2002 | Ertle |
| 6,474,087 | B1 | 11/2002 | Lifson |
| 6,536,221 | B2 | 3/2003 | James |
| 6,615,602 | B2 | 9/2003 | Wilkinson |
| 6,644,047 | B2 | 11/2003 | Taira |
| 6,655,164 | B2 | 12/2003 | Rogstam |
| 6,662,864 | B2 | 12/2003 | Burk et al. |
| 6,668,572 | B1 | 12/2003 | Seo et al. |
| 6,694,750 | B1 | 2/2004 | Lifson et al. |
| 6,729,151 | B1 | 5/2004 | Thompson |
| 6,751,972 | B1 | 6/2004 | Jungwirth |
| 6,804,975 | B2 | 10/2004 | Park |
| 6,817,205 | B1 | 11/2004 | Lifson et al. |
| 6,826,921 | B1 | 12/2004 | Uselton |
| 6,857,285 | B2 | 2/2005 | Hebert |
| 6,892,553 | B1 | 5/2005 | Lifson et al. |
| 6,915,655 | B2 | 7/2005 | Lee et al. |
| 6,915,656 | B2 | 7/2005 | Ratliff |
| 6,931,871 | B2 | 8/2005 | Shaw et al. |
| 6,931,879 | B1 | 8/2005 | Wiggs |
| 6,938,438 | B2 | 9/2005 | Lifson et al. |
| 6,941,770 | B1 | 9/2005 | Taras et al. |
| 6,948,455 | B2 | 9/2005 | Ferguson et al. |
| 7,000,423 | B2 | 2/2006 | Lifson et al. |
| 7,017,827 | B2 | 3/2006 | Shah et al. |
| 7,028,492 | B2 | 4/2006 | Taras et al. |
| 7,028,768 | B2 | 4/2006 | Aler et al. |
| 7,044,200 | B2 | 5/2006 | Gupte et al. |
| 7,059,151 | B2 | 6/2006 | Taras et al. |
| 7,114,349 | B2 | 10/2006 | Lifson et al. |
| 7,150,160 | B2 | 12/2006 | Herbert |
| 7,155,922 | B2 | 1/2007 | Harmon et al. |
| 7,162,889 | B2 | 1/2007 | Lee et al. |
| 7,185,505 | B2 | 3/2007 | Kamimura |
| RE39,597 | E | 5/2007 | Rousseau |
| RE39,625 | E | 5/2007 | Shaw |
| 7,210,303 | B2 | 5/2007 | Zhang et al. |
| 7,228,696 | B2 | 6/2007 | Ambs et al. |
| 7,228,707 | B2 | 6/2007 | Lifson et al. |
| 7,234,311 | B2 | 6/2007 | Lifson et al. |
| 7,254,955 | B2 | 8/2007 | Otake et al. |
| 7,258,606 | B1 | 8/2007 | Reid |
| 7,263,848 | B2 | 9/2007 | Bhatti |
| 7,272,948 | B2 | 9/2007 | Taras et al. |
| 7,275,384 | B2 | 10/2007 | Taras et al. |
| 7,275,385 | B2 | 10/2007 | Abel et al. |
| 7,281,387 | B2 | 10/2007 | Daddis, Jr. et al. |
| 7,290,399 | B2 | 11/2007 | Taras et al. |
| 7,313,926 | B2 | 1/2008 | Gurin |
| 7,325,414 | B2 | 2/2008 | Taras et al. |
| 7,454,919 | B2 | 11/2008 | Ookoshi et al. |
| 7,484,374 | B2 | 2/2009 | Pham et al. |
| 7,559,293 | B2 | 7/2009 | Gordon et al. |
| 7,587,911 | B2 | 9/2009 | Yanik et al. |
| 7,617,697 | B2 | 11/2009 | Mccaughan |
| 7,628,028 | B2 | 12/2009 | Tolbert, Jr. et al. |
| 7,654,104 | B2 | 2/2010 | Groll et al. |
| 7,685,833 | B2 | 3/2010 | Ju et al. |
| 7,708,052 | B2 | 5/2010 | Leman et al. |
| 7,716,943 | B2 | 5/2010 | Seefeldt |
| 7,730,935 | B1 | 6/2010 | Bujak, Jr. |
| 7,752,855 | B2 | 7/2010 | Matsuoka et al. |
| 7,770,405 | B1 | 8/2010 | Dillon |
| 7,784,291 | B2 | 8/2010 | Butler et al. |
| 7,802,443 | B2 | 9/2010 | Wetzel |
| 7,806,171 | B2 | 10/2010 | Taras et al. |
| 7,823,404 | B2 | 11/2010 | Hanson |
| 7,832,461 | B2 | 11/2010 | Belady et al. |
| 7,845,185 | B2 | 12/2010 | Knight et al. |
| 7,845,190 | B2 | 12/2010 | Pearson |
| 7,854,137 | B2 | 12/2010 | Lifson et al. |
| 7,856,834 | B2 | 12/2010 | Haley |
| 7,878,010 | B2 | 2/2011 | Nishimura et al. |
| 7,913,501 | B2 | 3/2011 | Ellis et al. |
| 7,937,960 | B2 | 5/2011 | Matsui |
| 7,946,121 | B2 | 5/2011 | Yamaguchi et al. |
| 7,954,333 | B2 | 6/2011 | Yoshimi |
| 7,958,737 | B2 | 6/2011 | Lifson et al. |
| 7,975,495 | B2 | 7/2011 | Voorhis et al. |
| 7,975,506 | B2 | 7/2011 | James et al. |
| 7,980,086 | B2 | 7/2011 | Kotani et al. |
| 7,980,087 | B2 | 7/2011 | Anderson et al. |
| 7,997,092 | B2 | 8/2011 | Lifson et al. |
| 7,997,093 | B2 | 8/2011 | Kasahara |
| 8,011,199 | B1 | 9/2011 | Chen et al. |
| 8,033,123 | B2 | 10/2011 | Kasahara et al. |
| 8,037,713 | B2 | 10/2011 | Haley et al. |
| 8,037,931 | B2 | 10/2011 | Penev et al. |
| 8,041,460 | B2 | 10/2011 | Klinger et al. |
| 8,056,348 | B2 | 11/2011 | Murakami |
| 8,069,682 | B2 | 12/2011 | Yoshimi et al. |
| 8,074,459 | B2 | 12/2011 | Murakami et al. |
| 8,079,228 | B2 | 12/2011 | Lifson et al. |
| 8,079,229 | B2 | 12/2011 | Lifson et al. |
| 8,082,751 | B2 | 12/2011 | Wiggs |
| 8,099,195 | B2 | 1/2012 | Imes et al. |
| 8,108,076 | B2 | 1/2012 | Imes et al. |
| 8,112,181 | B2 | 2/2012 | Remsburg |
| 8,113,270 | B2 | 2/2012 | Rios et al. |
| 8,136,364 | B2 | 3/2012 | Lifson et al. |
| 8,140,279 | B2 | 3/2012 | Subbloie |
| 8,156,757 | B2 | 4/2012 | Doty et al. |
| 8,160,752 | B2 | 4/2012 | Weaver et al. |
| 8,191,376 | B2 | 6/2012 | Fox et al. |
| 8,215,121 | B2 | 7/2012 | Yoshimi et al. |
| 8,220,531 | B2 | 7/2012 | Murakami et al. |
| 8,226,777 | B2 | 7/2012 | Gaus et al. |

(56) References Cited

U.S. PATENT DOCUMENTS

| | | | |
|---|---|---|---|
| 8,235,101 | B2 | 8/2012 | Taras et al. |
| 8,240,165 | B2 | 8/2012 | Novotny |
| 8,286,438 | B2 | 10/2012 | Mccahill |
| 8,381,538 | B2 | 2/2013 | Lifson et al. |
| 8,397,522 | B2 | 3/2013 | Springer et al. |
| 8,402,779 | B2 | 3/2013 | Nishimura et al. |
| 8,418,482 | B2 | 4/2013 | Bush et al. |
| 8,418,486 | B2 | 4/2013 | Taras et al. |
| 8,424,326 | B2 | 4/2013 | Mitra et al. |
| 8,459,052 | B2 | 6/2013 | Bush et al. |
| 8,528,359 | B2 | 9/2013 | Lifson et al. |
| 8,555,703 | B2 | 10/2013 | Yoshimi et al. |
| 8,561,425 | B2 | 10/2013 | Mitra et al. |
| 8,561,427 | B2 | 10/2013 | Knight et al. |
| 8,567,487 | B2 | 10/2013 | Christensen et al. |
| 8,627,674 | B2 | 1/2014 | Platt |
| 8,631,661 | B2 | 1/2014 | Teige et al. |
| 8,631,666 | B2 | 1/2014 | Hinde et al. |
| 8,650,893 | B2 | 2/2014 | Hanson |
| 8,695,404 | B2 | 4/2014 | Kadle et al. |
| 8,701,432 | B1 | 4/2014 | Olson |
| 8,726,682 | B1 | 5/2014 | Olson |
| 8,726,684 | B2 | 5/2014 | Maire |
| 8,733,429 | B2 | 5/2014 | Harrison et al. |
| 8,756,943 | B2 | 6/2014 | Chen et al. |
| 8,761,944 | B2 | 6/2014 | Drew et al. |
| 8,769,982 | B2 | 7/2014 | Ignatiev et al. |
| 8,791,592 | B2 | 7/2014 | Kim et al. |
| 8,843,238 | B2 | 9/2014 | Wenzel et al. |
| 8,862,280 | B1 | 10/2014 | Dyess et al. |
| 8,910,419 | B1 | 12/2014 | Oberst |
| 8,919,139 | B2 | 12/2014 | Yamada et al. |
| 8,939,196 | B2 | 1/2015 | Morita et al. |
| 8,943,848 | B2 | 2/2015 | Phannavong et al. |
| 8,959,950 | B2 | 2/2015 | Doty et al. |
| 8,984,903 | B2 | 3/2015 | Itoh et al. |
| 8,997,503 | B2 | 4/2015 | Morisita |
| 9,031,106 | B2 | 5/2015 | Morel et al. |
| 9,031,706 | B2 | 5/2015 | Kim et al. |
| 9,052,125 | B1 | 6/2015 | Dostal |
| 9,068,757 | B2 | 6/2015 | Weston |
| 9,068,767 | B2 | 6/2015 | Lesage |
| 9,120,054 | B2 | 9/2015 | De Piero et al. |
| 9,145,880 | B2 | 9/2015 | Ellis |
| 9,146,045 | B2 | 9/2015 | Miglio |
| 9,175,867 | B2 | 11/2015 | Grohman |
| 9,234,663 | B2 | 1/2016 | Woo et al. |
| 9,261,290 | B2 | 2/2016 | Storm |
| 9,267,696 | B2 | 2/2016 | Gerlach |
| 9,271,571 | B2 | 3/2016 | DeLorean et al. |
| 9,297,565 | B2 | 3/2016 | Hung |
| 9,303,908 | B2 | 4/2016 | Kasahara |
| 9,383,026 | B2 | 7/2016 | Eggleston |
| 9,423,164 | B2 | 8/2016 | Andersson |
| 9,440,514 | B2 | 9/2016 | Kondo et al. |
| 9,459,032 | B2 | 10/2016 | Nishimura et al. |
| 9,513,065 | B2 | 12/2016 | Wiley et al. |
| 9,551,514 | B2 | 1/2017 | Tartakovsky |
| 9,562,700 | B2 | 2/2017 | Watanabe |
| 9,562,708 | B2 | 2/2017 | Medlock et al. |
| 9,595,070 | B2 | 3/2017 | Matsuoka et al. |
| 9,599,377 | B2 | 3/2017 | Kato |
| 9,625,195 | B2 | 4/2017 | Hiraki et al. |
| 9,625,222 | B2 | 4/2017 | Fischer et al. |
| 9,664,411 | B2 | 5/2017 | Shaffer |
| 9,677,778 | B2 | 6/2017 | Miglio |
| 9,677,779 | B2 | 6/2017 | Miglio |
| 9,739,492 | B2 | 8/2017 | Medlock et al. |
| 9,791,195 | B2 | 10/2017 | Okada et al. |
| 9,797,611 | B2 | 10/2017 | Gault |
| 9,829,219 | B2 | 11/2017 | Freese et al. |
| 9,835,385 | B2 | 12/2017 | Ebster |
| 9,845,978 | B2 | 12/2017 | Nelson |
| 9,851,114 | B2 | 12/2017 | Zinger et al. |
| RE46,708 | E | 2/2018 | Karamanos |
| 9,884,536 | B2 | 2/2018 | Katayama |
| 9,885,504 | B2 | 2/2018 | Xu et al. |
| 9,909,785 | B2 | 3/2018 | Kato |
| 9,909,792 | B2 | 3/2018 | Oya |
| 9,915,450 | B2 | 3/2018 | Seggerman |
| 9,920,953 | B2 | 3/2018 | Ward |
| 9,920,960 | B2 | 3/2018 | Gerber et al. |
| 9,958,175 | B2 | 5/2018 | Yamashita |
| 10,060,296 | B2 | 8/2018 | Friesth |
| 10,066,877 | B2 | 9/2018 | Rich et al. |
| 10,072,856 | B1 | 9/2018 | Akin et al. |
| 10,072,863 | B2 | 9/2018 | Wallace |
| 10,107,508 | B2 | 10/2018 | Medlock et al. |
| 10,118,462 | B2 | 11/2018 | Kohigashi et al. |
| 10,119,738 | B2 | 11/2018 | Hammond et al. |
| 10,126,012 | B2 | 11/2018 | Ikawa et al. |
| 10,132,511 | B2 | 11/2018 | Tartakovsky |
| 10,132,572 | B2 | 11/2018 | Sakamaki et al. |
| 10,151,516 | B2 | 12/2018 | Shang et al. |
| 10,151,663 | B2 | 12/2018 | Scancarello |
| 10,161,658 | B2 | 12/2018 | Russo et al. |
| 10,179,307 | B2 | 1/2019 | De Piero et al. |
| 10,234,164 | B2 | 3/2019 | Takeuchi et al. |
| 10,240,849 | B2 | 3/2019 | DeLia |
| 10,247,481 | B2 | 4/2019 | Taras et al. |
| 10,337,799 | B2 | 7/2019 | Taras |
| 10,345,004 | B1 | 7/2019 | Hern et al. |
| 10,408,472 | B1 | 9/2019 | Miglio |
| 10,408,484 | B2 | 9/2019 | Honda et al. |
| 10,465,961 | B2 | 11/2019 | Kujak |
| 10,480,807 | B2 | 11/2019 | Goel et al. |
| 10,488,065 | B2 | 11/2019 | Chen et al. |
| 10,488,072 | B2 | 11/2019 | Yajima et al. |
| 10,508,847 | B2 | 12/2019 | Yajima et al. |
| 10,514,176 | B2 | 12/2019 | Weinert |
| 10,527,310 | B2 | 1/2020 | Nagaoka et al. |
| 10,539,333 | B2 | 1/2020 | Andersson |
| 10,598,403 | B2 | 3/2020 | Woods |
| 10,670,282 | B2 | 6/2020 | Yamada et al. |
| 10,677,679 | B2 | 6/2020 | Gupte et al. |
| 10,684,052 | B2 | 6/2020 | Walser et al. |
| 10,731,870 | B2 | 8/2020 | Betz |
| 10,731,884 | B2 | 8/2020 | Blanton |
| 10,753,631 | B2 | 8/2020 | Ikawa et al. |
| 10,753,661 | B2 | 8/2020 | Hammond et al. |
| 10,767,882 | B2 | 9/2020 | Kowald et al. |
| 10,788,227 | B2 | 9/2020 | Brown et al. |
| 10,801,747 | B2 | 10/2020 | Benefield et al. |
| 10,808,615 | B2 | 10/2020 | Kustura et al. |
| 10,816,232 | B2 | 10/2020 | Crawford et al. |
| 10,866,002 | B2 | 12/2020 | Taras et al. |
| 10,866,004 | B2 | 12/2020 | Shiohama et al. |
| 10,871,314 | B2 | 12/2020 | Taras et al. |
| 10,900,675 | B2 | 1/2021 | Medlock et al. |
| 10,914,482 | B2 | 2/2021 | Yamamoto et al. |
| 10,928,092 | B2 | 2/2021 | Yajima et al. |
| 10,935,260 | B2 | 3/2021 | Taras et al. |
| 10,935,454 | B2 | 3/2021 | Kester |
| 10,941,953 | B2 | 3/2021 | Goel et al. |
| 10,996,131 | B2 | 5/2021 | Mcquade et al. |
| 11,015,828 | B2 | 5/2021 | Sakae et al. |
| 11,015,852 | B2 | 5/2021 | Sakae et al. |
| 11,015,854 | B2 | 5/2021 | Jacobi |
| 11,015,871 | B2 | 5/2021 | Wallet-Laily et al. |
| 11,022,354 | B2 | 6/2021 | Yamada et al. |
| 11,041,647 | B2 | 6/2021 | Weinert |
| 11,041,666 | B2 | 6/2021 | Sakae et al. |
| 11,060,746 | B2 | 7/2021 | Maddox et al. |
| 11,060,775 | B2 | 7/2021 | Delgoshaei |
| 11,073,301 | B2 | 7/2021 | Singh et al. |
| 11,079,149 | B2 | 8/2021 | Papas et al. |
| 11,092,566 | B2 | 8/2021 | Chen et al. |
| 11,098,915 | B2 | 8/2021 | Crawford |
| 11,098,937 | B2 | 8/2021 | Uehara et al. |
| 11,098,962 | B2 | 8/2021 | Rajani |
| 11,125,457 | B1 | 9/2021 | Alfano et al. |
| 11,131,470 | B2 | 9/2021 | Minamida et al. |
| 11,137,172 | B2 | 10/2021 | Kniffler et al. |
| 11,162,695 | B2 | 11/2021 | Lee et al. |

(56) References Cited

U.S. PATENT DOCUMENTS 11,162,706 B2 11/2021 Bhosale et al.
11,187,418 B1 11/2021 DeLoach et al.
11,231,197 B2 1/2022 Mcquade et al.
11,248,816 B2 2/2022 Ikawa et al.
11,268,718 B2 3/2022 Minamida et al.
11,268,722 B2 3/2022 Ferrere et al.
11,274,866 B2 3/2022 Yamada et al.
11,274,871 B2 3/2022 Sakae et al.
11,280,523 B2 3/2022 Sakae et al.
11,287,153 B2 3/2022 Delgoshaei
11,293,674 B2 4/2022 Yamada et al.
11,313,571 B2 4/2022 Patel et al.
11,326,798 B2 5/2022 Green et al.
11,326,830 B2 5/2022 Jacobi
11,365,897 B2 6/2022 Blanton
11,391,474 B2 7/2022 Eplee
11,408,624 B2 8/2022 Hovardas et al.
11,415,345 B2 8/2022 Yajima
11,415,381 B2 8/2022 Fox et al.
11,428,435 B2 8/2022 Eskew et al.
11,441,803 B2 9/2022 Goel et al.
11,466,872 B2 10/2022 Clark et al.
11,525,600 B2 12/2022 Lee
11,565,213 B2 1/2023 Liu
11,592,201 B2 2/2023 Brown et al.
11,592,203 B2 2/2023 Matsuda et al.
11,598,556 B2 3/2023 Mueller et al.
11,614,285 B2 3/2023 Huang et al.
11,629,866 B2 4/2023 Blanton et al.
11,655,986 B2 5/2023 Han et al.
11,655,990 B2 5/2023 Chen et al.
11,660,568 B2 5/2023 Mark et al.
11,668,477 B2 6/2023 Reynolds et al.
11,713,890 B2 8/2023 Medlock et al.
11,713,901 B2 8/2023 Shaffer et al.
11,761,666 B2 9/2023 Atchison et al.
11,796,213 B2 10/2023 Ehrman
11,833,884 B2 12/2023 Tani
11,850,912 B2 12/2023 Heering
11,859,875 B2 1/2024 Jovet
11,918,954 B2 3/2024 Vezil et al.
11,927,364 B2 3/2024 Daniel et al.
11,927,375 B2 3/2024 Gallant et al.
11,933,505 B2 3/2024 Wardrop et al.
11,933,523 B2 3/2024 Snider et al.
11,953,240 B2 4/2024 Raimbault et al.
11,965,672 B2 4/2024 Locke et al.
12,044,421 B2 7/2024 Fischer
12,044,431 B2 7/2024 Martin, Sr.
12,066,223 B2 8/2024 Tolouee
12,117,200 B2 10/2024 Medlock et al.
12,173,972 B2 12/2024 Li et al.
12,188,676 B2 1/2025 Wallace
12,196,442 B2 1/2025 Yu et al.
12,247,760 B2 3/2025 Yu et al.
2002/0078705 A1 6/2002 Schlosser et al.
2003/0061822 A1 4/2003 Rafalovich
2003/0132850 A1 7/2003 Ozawa
2003/0201097 A1 10/2003 Zeigler et al.
2003/0221436 A1 12/2003 Xu
2003/0221445 A1 12/2003 Smolinsky
2004/0134226 A1 7/2004 Kraay et al.
2004/0140082 A1 7/2004 Hua
2004/0188082 A1 9/2004 Riello
2005/0000473 A1 1/2005 Ap et al.
2005/0125083 A1 6/2005 Kiko
2005/0161520 A1 7/2005 Gast
2005/0167080 A1 8/2005 Yoho
2006/0010908 A1 1/2006 Taras et al.
2006/0218949 A1 10/2006 Ellis et al.
2006/0225445 A1 10/2006 Lifson et al.
2007/0000262 A1 1/2007 Ikegami et al.
2007/0012058 A1 1/2007 Cho et al.
2007/0017243 A1 1/2007 Kidwell et al.
2007/0066215 A1 3/2007 Song et al.
2007/0074536 A1 4/2007 Bai
2007/0146229 A1 6/2007 Lin
2007/0214815 A1 9/2007 Lewkowitz et al.
2007/0251256 A1 11/2007 Pham et al.
2007/0289319 A1 12/2007 Kim et al.
2007/0295477 A1 12/2007 Mueller et al.
2008/0016895 A1 1/2008 Kim et al.
2008/0033599 A1 2/2008 Aminpour et al.
2008/0041072 A1 2/2008 Seefeldt
2008/0053115 A1 3/2008 Trantham
2008/0092564 A1 4/2008 Sulc et al.
2008/0156468 A1 7/2008 Hammond
2008/0173034 A1 7/2008 Shaw
2008/0196418 A1 8/2008 Lifson et al.
2008/0197206 A1 8/2008 Murakami et al.
2008/0209930 A1 9/2008 Taras et al.
2008/0250807 A1 10/2008 Park
2008/0256975 A1 10/2008 Lifson et al.
2008/0271881 A1 11/2008 Blecker
2008/0276638 A1* 11/2008 Seefeldt ..... F25B 1/10 62/238.7
2008/0282718 A1 11/2008 Beagle
2008/0286118 A1 11/2008 Gu et al.
2008/0289795 A1 11/2008 Zhang et al.
2008/0296396 A1 12/2008 Corroy et al.
2008/0302113 A1 12/2008 Yin et al.
2008/0302118 A1 12/2008 Chen et al.
2008/0302129 A1 12/2008 Mosemann et al.
2008/0307813 A1 12/2008 Lifson et al.
2008/0309210 A1 12/2008 Luisi et al.
2009/0000611 A1 1/2009 Kaiser
2009/0031739 A1 2/2009 Kasahara et al.
2009/0037142 A1 2/2009 Kates
2009/0044550 A1 2/2009 Nishimura et al.
2009/0084131 A1 4/2009 Reifel et al.
2009/0095000 A1 4/2009 Yoshimi et al.
2009/0099814 A1 4/2009 Scott
2009/0100849 A1 4/2009 Nishimura et al.
2009/0107656 A1 4/2009 Marois
2009/0139255 A1 6/2009 Hombucher
2009/0151388 A1 6/2009 Platt et al.
2009/0208331 A1 8/2009 Haley et al.
2009/0216382 A1 8/2009 Ng
2009/0293517 A1 12/2009 Bittner
2009/0294097 A1 12/2009 Rini et al.
2009/0314014 A1 12/2009 Ericsson
2009/0314017 A1 12/2009 Nishimura et al.
2009/0321041 A1 12/2009 Hammond
2010/0005821 A1 1/2010 Mccahill
2010/0005831 A1 1/2010 Vaisman et al.
2010/0024470 A1 2/2010 Lifson et al.
2010/0031686 A1 2/2010 Platt
2010/0038052 A1 2/2010 Johnson et al.
2010/0058781 A1 3/2010 Taras et al.
2010/0064710 A1 3/2010 Slaughter
2010/0064722 A1 3/2010 Taras
2010/0064724 A1 3/2010 Platt
2010/0064824 A1 3/2010 Oguma et al.
2010/0065262 A1 3/2010 Platt
2010/0070907 A1 3/2010 Harrod et al.
2010/0077788 A1 4/2010 Lewis
2010/0088261 A1 4/2010 Montalvo
2010/0102136 A1 4/2010 Hadzidedic et al.
2010/0106641 A1 4/2010 Chassin et al.
2010/0107071 A1 4/2010 Pavlak et al.
2010/0108290 A1 5/2010 Maxwell
2010/0114384 A1 5/2010 Maxwell
2010/0132390 A1 6/2010 Platt et al.
2010/0132399 A1 6/2010 Mitra et al.
2010/0199715 A1 8/2010 Lifson et al.
2010/0243202 A1 9/2010 Han et al.
2010/0251750 A1 10/2010 Lifson et al.
2010/0281894 A1 11/2010 Huff
2010/0287960 A1 11/2010 Meister
2010/0287969 A1 11/2010 Ueda et al.
2010/0289643 A1 11/2010 Trundle et al.
2010/0326100 A1 12/2010 Taras et al.
2011/0023515 A1 2/2011 Kopko et al.
2011/0036119 A1 2/2011 Fujimoto et al.

(56) References Cited

U.S. PATENT DOCUMENTS

2011/0041523 A1 2/2011 Taras et al.
2011/0041534 A1 2/2011 Hombucher
2011/0061413 A1 3/2011 Setoguchi
2011/0073285 A1 3/2011 Benoit et al.
2011/0079032 A1 4/2011 Taras et al.
2011/0088426 A1 4/2011 Lochtefeld
2011/0094248 A1 4/2011 Taras et al.
2011/0094259 A1 4/2011 Lifson et al.
2011/0107780 A1 5/2011 Yamaguchi et al.
2011/0132007 A1 6/2011 Weyna et al.
2011/0146317 A1 6/2011 Cline et al.
2011/0166710 A1 7/2011 Kordik et al.
2011/0174014 A1 7/2011 Scarcella et al.
2011/0192176 A1 8/2011 Kim et al.
2011/0202185 A1 8/2011 Imes et al.
2011/0203299 A1 8/2011 Jing et al.
2011/0209487 A1 9/2011 Tachiki et al.
2011/0209490 A1 9/2011 Mijanovic et al.
2011/0252820 A1 10/2011 Hockman et al.
2011/0252821 A1 10/2011 Miglio
2011/0259025 A1 10/2011 Noh et al.
2011/0272117 A1 11/2011 Hamstra et al.
2011/0289950 A1 12/2011 Kim et al.
2011/0289952 A1 12/2011 Kim et al.
2011/0296861 A1 12/2011 Honda
2011/0305839 A1 12/2011 Yanagimoto et al.
2012/0011866 A1 1/2012 Scarcella et al.
2012/0022700 A1 1/2012 Drees et al.
2012/0047929 A1 3/2012 Delorme et al.
2012/0067965 A1 3/2012 Rajasekaran et al.
2012/0090337 A1 4/2012 Chen et al.
2012/0095605 A1 4/2012 Tran
2012/0101637 A1 4/2012 Imes et al.
2012/0103005 A1 5/2012 Kopko et al.
2012/0139491 A1 6/2012 Eberhard et al.
2012/0180986 A1 7/2012 Mathews
2012/0191254 A1 7/2012 Cho
2012/0198867 A1 8/2012 Ng et al.
2012/0205077 A1 8/2012 Zinger et al.
2012/0210736 A1 8/2012 Rockenfeller et al.
2012/0216558 A1 8/2012 Dempsey et al.
2012/0221150 A1 8/2012 Arensmeier
2012/0222441 A1 9/2012 Sawada et al.
2012/0247134 A1 10/2012 Gurin
2012/0279681 A1 11/2012 Vaughan et al.
2012/0291460 A1 11/2012 Aoyagi
2012/0297811 A1 11/2012 Miglio
2012/0315562 A1 12/2012 Park
2013/0008193 A1 1/2013 Platt
2013/0008199 A1 1/2013 Platt et al.
2013/0014451 A1 1/2013 Russell et al.
2013/0018609 A1 1/2013 Filippenko et al.
2013/0024799 A1 1/2013 Fadell et al.
2013/0031934 A1 2/2013 Huff et al.
2013/0074786 A1 3/2013 Lesage et al.
2013/0092329 A1 4/2013 Eastland
2013/0098085 A1 4/2013 Judge et al.
2013/0104574 A1 5/2013 Dempsey et al.
2013/0160985 A1 6/2013 Chen et al.
2013/0180266 A1 7/2013 Bois
2013/0186116 A1 7/2013 Sami
2013/0199772 A1 8/2013 Fischer et al.
2013/0269378 A1 10/2013 Wong
2013/0305756 A1 11/2013 Gomes et al.
2013/0319027 A1 12/2013 Tsubouchi
2013/0340972 A1 12/2013 Fukuda
2014/0000736 A1 1/2014 Ellis
2014/0013782 A1 1/2014 Kopko et al.
2014/0013788 A1 1/2014 Kopko et al.
2014/0033753 A1 2/2014 Lu et al.
2014/0033755 A1 2/2014 Wong
2014/0053585 A1 2/2014 Huff
2014/0060101 A1 3/2014 Styles et al.
2014/0075970 A1 3/2014 Benson
2014/0102126 A1 4/2014 Aoun et al.
2014/0123689 A1 5/2014 Ellis et al.
2014/0137813 A1 5/2014 Gross et al.
2014/0150988 A1 6/2014 Medlock et al.
2014/0165596 A1 6/2014 Freese et al.
2014/0245770 A1* 9/2014 Chen ..... F25B 29/003 62/238.7
2014/0260356 A1 9/2014 Wu
2014/0260373 A1 9/2014 Gerber et al.
2014/0260392 A1 9/2014 Hawkins et al.
2014/0316584 A1 10/2014 Matsuoka et al.
2015/0040607 A1 2/2015 Miglio
2015/0052937 A1 2/2015 Hung
2015/0059373 A1 3/2015 Maiello et al.
2015/0060007 A1 3/2015 Smith
2015/0068740 A1 3/2015 Broder
2015/0195954 A1 7/2015 Orsini
2015/0198353 A1 7/2015 Platt
2015/0204586 A1 7/2015 Burg et al.
2015/0252653 A1 9/2015 Shelton, Jr.
2015/0285539 A1 10/2015 Kopko
2015/0330689 A1 11/2015 Kato et al.
2015/0338139 A1 11/2015 Xu et al.
2015/0366105 A1 12/2015 Dunwoody et al.
2016/0040906 A1 2/2016 Aguilar et al.
2016/0076950 A1 3/2016 Jacquet
2016/0109156 A1 4/2016 Yin
2016/0238276 A1 8/2016 Andrew et al.
2016/0265819 A1 9/2016 Durrani et al.
2017/0010029 A9 1/2017 Reytblat et al.
2017/0051477 A1 2/2017 Sawyer et al.
2017/0067396 A1 3/2017 Kustura et al.
2017/0130976 A1 5/2017 Medlock et al.
2017/0227250 A1 8/2017 Karamanos
2017/0248354 A1 8/2017 Lord et al.
2017/0298866 A1 10/2017 Goricanec et al.
2017/0314814 A1 11/2017 Benedict et al.
2017/0328588 A1 11/2017 Medlock et al.
2017/0336092 A1 11/2017 Ikawa et al.
2017/0370622 A1 12/2017 Shin et al.
2018/0010829 A1 1/2018 Taras et al.
2018/0093900 A1 4/2018 Dickson et al.
2018/0128506 A1 5/2018 Taras et al.
2018/0142935 A1 5/2018 Jacobi
2018/0156471 A1 6/2018 Shaffer et al.
2018/0195778 A1 7/2018 Crawford
2018/0283703 A1 10/2018 Hong et al.
2018/0292141 A1 10/2018 Steinbauer et al.
2018/0299146 A1 10/2018 Komatsu et al.
2018/0313555 A1 11/2018 Henderson
2018/0328600 A1 11/2018 Swanson
2018/0334794 A1 11/2018 Janabi
2018/0363969 A1 12/2018 Jacobi
2019/0032981 A1 1/2019 Hammond et al.
2019/0049126 A1 2/2019 Medlock et al.
2019/0145640 A1 5/2019 Vandermeulen et al.
2019/0154281 A1 5/2019 Rosenblum et al.
2019/0170600 A1 6/2019 Tice et al.
2019/0170603 A1 6/2019 Gupte et al.
2019/0178509 A1 6/2019 Taras et al.
2019/0346158 A1 11/2019 Kamada
2019/0351731 A1 11/2019 Jeong
2019/0353361 A1 11/2019 Attari
2020/0041187 A1 2/2020 Huckaby et al.
2020/0049381 A1 2/2020 Thielmann
2020/0072510 A1 3/2020 Brown
2020/0096259 A1 3/2020 Pearson et al.
2020/0116415 A1 4/2020 Erpelding et al.
2020/0263891 A1 8/2020 Noor et al.
2020/0300525 A1 9/2020 Jacobi
2020/0355411 A1 11/2020 Inoue et al.
2020/0378667 A1 12/2020 Hammond et al.
2021/0018234 A1 1/2021 Lingrey et al.
2021/0041115 A1 2/2021 Yoshioka et al.
2021/0071920 A1 3/2021 Yamada et al.
2021/0095872 A1 4/2021 Taras et al.
2021/0131696 A1 5/2021 She et al.
2021/0131706 A1 5/2021 Yamada et al.
2021/0131709 A1 5/2021 Taras et al.
2021/0148585 A1 5/2021 Medlock et al.

(56) References Cited

U.S. PATENT DOCUMENTS

| | | | |
|---|---|---|---|
| 2021/0180807 | A1 | 6/2021 | Taras et al. |
| 2021/0180836 | A1 | 6/2021 | Tolouee |
| 2021/0207831 | A1 | 7/2021 | Lord et al. |
| 2021/0231330 | A1 | 7/2021 | Stephens et al. |
| 2021/0270501 | A1 | 9/2021 | Brown et al. |
| 2021/0293418 | A1 | 9/2021 | Fuse et al. |
| 2021/0293430 | A1 | 9/2021 | Yamada |
| 2021/0293446 | A1 | 9/2021 | Fard |
| 2021/0302051 | A1 | 9/2021 | Yamada et al. |
| 2021/0318012 | A1 | 10/2021 | Yamada et al. |
| 2021/0325081 | A1 | 10/2021 | Kagawa et al. |
| 2021/0341170 | A1 | 11/2021 | Hikawa et al. |
| 2021/0348820 | A1 | 11/2021 | Kobayashi et al. |
| 2021/0356154 | A1 | 11/2021 | Kobayashi et al. |
| 2021/0389014 | A1 | 12/2021 | Moffet |
| 2022/0034527 | A1 | 2/2022 | Shamshoian |
| 2022/0082268 | A1 | 3/2022 | Hammond et al. |
| 2022/0090833 | A1 | 3/2022 | Yajima |
| 2022/0090864 | A1 | 3/2022 | Joardar et al. |
| 2022/0099346 | A1 | 3/2022 | Alfano et al. |
| 2022/0128277 | A1 | 4/2022 | Fukuyama et al. |
| 2022/0136712 | A1 | 5/2022 | Ardha |
| 2022/0186989 | A1 | 6/2022 | Yamaguchi et al. |
| 2022/0243939 | A1 | 8/2022 | Notaro et al. |
| 2022/0243940 | A1 | 8/2022 | Notaro et al. |
| 2022/0243952 | A1 | 8/2022 | Kojima |
| 2022/0247846 | A1 | 8/2022 | Lim |
| 2022/0250434 | A1 | 8/2022 | Heering |
| 2022/0250464 | A1 | 8/2022 | Chandler |
| 2022/0268492 | A1 | 8/2022 | Yajima |
| 2022/0297504 | A1 | 9/2022 | Schroeder |
| 2022/0348052 | A1 | 11/2022 | Fox et al. |
| 2022/0380648 | A1 | 12/2022 | Kumakura et al. |
| 2022/0404099 | A1 | 12/2022 | Arnou et al. |
| 2023/0020557 | A1 | 1/2023 | Kaji et al. |
| 2023/0052745 | A1 | 2/2023 | Kitagawa et al. |
| 2023/0072254 | A1 | 3/2023 | Lamont et al. |
| 2023/0094980 | A1 | 3/2023 | Birnkrant et al. |
| 2023/0097829 | A1 | 3/2023 | Ohkubo et al. |
| 2023/0097844 | A1 | 3/2023 | Birnkrant |
| 2023/0106462 | A1 | 4/2023 | Hovardas et al. |
| 2023/0114621 | A1 | 4/2023 | Aoki et al. |
| 2023/0119391 | A1 | 4/2023 | Tinsley |
| 2023/0124368 | A1 | 4/2023 | Livingston et al. |
| 2023/0132359 | A2 | 4/2023 | Kumakura |
| 2023/0160587 | A1 | 5/2023 | Delgoshaei et al. |
| 2023/0184618 | A1 | 6/2023 | Gupte et al. |
| 2023/0194137 | A1 | 6/2023 | Fan et al. |
| 2023/0205237 | A1 | 6/2023 | Karamanos et al. |
| 2023/0213252 | A1 | 7/2023 | Mcquade |
| 2023/0213254 | A1 | 7/2023 | Ma |
| 2023/0221025 | A1 | 7/2023 | Nakano et al. |
| 2023/0221026 | A1 | 7/2023 | Blanton |
| 2023/0235907 | A1 | 7/2023 | Dewald et al. |
| 2023/0243534 | A1 | 8/2023 | Song et al. |
| 2023/0243539 | A1 | 8/2023 | Buda |
| 2023/0243546 | A1 | 8/2023 | Ehrman |
| 2023/0250973 | A1 | 8/2023 | Fulda |
| 2023/0250974 | A1 | 8/2023 | Xu et al. |
| 2023/0250981 | A1 | 8/2023 | Notaro et al. |
| 2023/0266026 | A1 | 8/2023 | Notaro et al. |
| 2023/0324053 | A1 | 10/2023 | Fulda |
| 2023/0375198 | A1 | 11/2023 | Medlock et al. |
| 2023/0383964 | A1 | 11/2023 | Yang |
| 2024/0003584 | A1 | 1/2024 | Willhite et al. |
| 2024/0003591 | A1 | 1/2024 | Bjørn et al. |
| 2024/0044546 | A1 | 2/2024 | Barrett |
| 2024/0125488 | A1 | 4/2024 | Fukuyama et al. |
| 2024/0159411 | A1 | 5/2024 | Masetti et al. |
| 2024/0167701 | A1 | 5/2024 | Dorna et al. |
| 2024/0200795 | A1 | 6/2024 | Gross |
| 2024/0200827 | A1 | 6/2024 | Deivasigamani |
| 2024/0200828 | A1 | 6/2024 | Wang |
| 2024/0247845 | A1 | 7/2024 | Taras |
| 2024/0295341 | A1 | 9/2024 | Charming et al. |
| 2024/0337401 | A1 | 10/2024 | Takahashi et al. |
| 2024/0377104 | A1 | 11/2024 | Xue |
| 2024/0401890 | A1 | 12/2024 | Struewing et al. |
| 2024/0410662 | A1 | 12/2024 | Narayanan et al. |
| 2025/0012457 | A1 | 1/2025 | Fabian |
| 2025/0020347 | A1 | 1/2025 | Shaffer |
| 2025/0027665 | A1 | 1/2025 | Schechner et al. |

FOREIGN PATENT DOCUMENTS

| | | | |
|---|---|---|---|
| CA | 2225590 | A1 | 7/1999 |
| CA | 2 572 418 | A1 | 6/2008 |
| CA | 2 588 150 | C | 10/2009 |
| CA | 2 809 160 | A1 | 9/2014 |
| CN | 1987397 | | 6/2007 |
| CN | 101158507 | A | 4/2008 |
| CN | 101187515 | A | 5/2008 |
| CN | 201074923 | Y | 6/2008 |
| CN | 101403543 | B | 6/2010 |
| CN | 101140122 | B | 5/2011 |
| CN | 201944952 | | 8/2011 |
| CN | 102353126 | | 2/2012 |
| CN | 202361697 | U | 8/2012 |
| CN | 202361718 | U | 8/2012 |
| CN | 202420029 | U | 9/2012 |
| CN | 202470558 | U | 10/2012 |
| CN | 103123192 | A | 5/2013 |
| CN | 203231582 | | 10/2013 |
| CN | 103471275 | | 12/2013 |
| CN | 203396155 | | 1/2014 |
| CN | 203432025 | | 2/2014 |
| CN | 203518333 | U | 4/2014 |
| CN | 102798214 | B | 4/2015 |
| CN | 105020924 | A | 11/2015 |
| CN | 103528267 | B | 12/2015 |
| CN | 105135676 | A | 12/2015 |
| CN | 104482596 | B | 4/2017 |
| CN | 104676962 | B | 4/2017 |
| CN | 104748442 | B | 8/2017 |
| CN | 207073966 | U | 3/2018 |
| CN | 107883620 | A | 4/2018 |
| CN | 207438787 | U | 6/2018 |
| CN | 108362032 | A | 8/2018 |
| CN | 207797448 | U | 8/2018 |
| CN | 208012145 | U | 10/2018 |
| CN | 106196698 | B | 4/2019 |
| CN | 106705489 | B | 5/2019 |
| CN | 209101613 | U | 7/2019 |
| CN | 110186213 | A | 8/2019 |
| CN | 209926641 | U | 1/2020 |
| CN | 111503784 | A | 8/2020 |
| CN | 111503940 | A | 8/2020 |
| CN | 111720899 | A | 9/2020 |
| CN | 212205141 | U | 12/2020 |
| CN | 213178898 | U | 5/2021 |
| CN | 111336721 | B | 6/2021 |
| CN | 213334652 | U | 6/2021 |
| CN | 213873277 | U | 8/2021 |
| CN | 113551442 | A | 10/2021 |
| CN | 214841773 | U | 11/2021 |
| CN | 215951822 | U | 3/2022 |
| CN | 217584960 | U | 10/2022 |
| CN | 107131672 | B | 11/2022 |
| CN | 110057136 | B | 11/2022 |
| CN | 115435444 | | 12/2022 |
| CN | 115468229 | | 12/2022 |
| CN | 115493250 | | 12/2022 |
| CN | 115523604 | | 12/2022 |
| CN | 218154901 | U | 12/2022 |
| CN | 115638523 | | 1/2023 |
| CN | 112665220 | B | 2/2023 |
| CN | 115711454 | | 2/2023 |
| CN | 218511135 | | 2/2023 |
| CN | 107655124 | B | 3/2023 |
| CN | 115751508 | | 3/2023 |
| CN | 115751603 | | 3/2023 |
| CN | 115854484 | | 3/2023 |
| CN | 115854488 | | 3/2023 |
| CN | 218672483 | | 3/2023 |

(56) References Cited

FOREIGN PATENT DOCUMENTS

| | | | |
|---|---|---|---|
| CN | 115930357 | | 4/2023 |
| CN | 115978709 | | 4/2023 |
| CN | 115978710 | | 4/2023 |
| CN | 116007066 | | 4/2023 |
| CN | 116025999 | | 4/2023 |
| CN | 218915295 | | 4/2023 |
| CN | 116085938 | | 5/2023 |
| CN | 116085939 | | 5/2023 |
| CN | 116123663 | | 5/2023 |
| CN | 116221902 | | 6/2023 |
| CN | 116241979 | | 6/2023 |
| CN | 116242010 | | 6/2023 |
| CN | 116294062 | | 6/2023 |
| CN | 116294111 | | 6/2023 |
| CN | 116336607 | | 6/2023 |
| CN | 219415010 | | 7/2023 |
| CN | 116538638 | | 8/2023 |
| CN | 116558042 | | 8/2023 |
| CN | 116608539 | | 8/2023 |
| CN | 219693510 | | 9/2023 |
| CN | 109974327 | B | 2/2024 |
| CN | 221923713 | U | 10/2024 |
| DE | 210 737 | A1 | 6/1984 |
| DE | 20 2008 002 015 | U1 | 5/2008 |
| DE | 102007050446 | | 4/2009 |
| DE | 10 2017 011 635 | A1 | 6/2019 |
| DE | 202022106612 | | 3/2023 |
| EP | 0134015 | | 3/1985 |
| EP | 0 069 756 | B1 | 7/1985 |
| EP | 1 521 152 | A2 | 4/2005 |
| EP | 1 591 978 | A2 | 11/2005 |
| EP | 1 304 528 | B1 | 6/2006 |
| EP | 1736720 | | 12/2006 |
| EP | 1983275 | | 10/2008 |
| EP | 2108897 | | 6/2017 |
| EP | 3358279 | | 6/2020 |
| EP | 3 540 331 | B1 | 11/2020 |
| EP | 3447403 | | 6/2021 |
| EP | 4036486 | | 8/2022 |
| EP | 4180727 | | 5/2023 |
| EP | 4194769 | | 6/2023 |
| EP | 3 514 464 | B1 | 12/2023 |
| EP | 3 943 820 | B1 | 5/2024 |
| ES | 2946857 | | 7/2023 |
| FR | 2 995 979 | A1 | 3/2014 |
| FR | 3 034 850 | B1 | 6/2019 |
| GB | 1061357 | A | 3/1967 |
| GB | 2516030 | A | 1/2015 |
| IN | 201917005053 | | 4/2019 |
| IN | 20197018373 | | 7/2019 |
| IN | 201917012216 | | 7/2019 |
| IN | 202117017765 | | 1/2022 |
| IN | 202117017768 | | 1/2022 |
| IN | 202117018393 | | 1/2022 |
| IN | 202118001637 | | 1/2022 |
| JP | 2000046417 | | 2/2000 |
| JP | 2000274786 | | 10/2000 |
| JP | 2000314563 | | 11/2000 |
| JP | 2001248931 | | 9/2001 |
| JP | 3610812 | | 1/2005 |
| JP | 3744330 | | 12/2005 |
| JP | 2010101515 | | 5/2010 |
| JP | 2010101606 | | 5/2010 |
| JP | 2010133601 | | 6/2010 |
| JP | 2010230181 | | 10/2010 |
| JP | 2014-47970 | A | 3/2014 |
| JP | 2015094574 | | 5/2015 |
| JP | 2015175531 | | 10/2015 |
| JP | 2017075760 | | 4/2017 |
| JP | 2018-54196 | A | 4/2018 |
| JP | 2020051737 | | 4/2020 |
| JP | 6723887 | B2 | 7/2020 |
| JP | 2021103053 | | 7/2021 |
| JP | 2022039608 | | 3/2022 |
| JP | 2022176373 | | 11/2022 |
| JP | 2023025165 | | 2/2023 |
| JP | 2023060225 | | 4/2023 |
| JP | 2023076482 | | 6/2023 |
| JP | 2023116473 | | 8/2023 |
| KR | 10-2008-0060852 | A | 7/2008 |
| KR | 100963221 | | 6/2010 |
| KR | 10-1961170 | B1 | 7/2019 |
| KR | 20190090972 | | 8/2019 |
| KR | 102551281 | | 7/2023 |
| KR | 102551284 | | 7/2023 |
| KR | 102551286 | | 7/2023 |
| KR | 102569930 | | 8/2023 |
| KR | 10-2727264 | B1 | 11/2024 |
| NL | 7902799 | A | 10/1980 |
| PL | 229146 | B1 | 6/2018 |
| RU | 2 725 127 | C1 | 6/2020 |
| TW | I557385 | B | 11/2016 |
| WO | WO 95/28609 | A1 | 10/1995 |
| WO | WO 9600370 | | 1/1996 |
| WO | WO 97/32168 | A1 | 9/1997 |
| WO | WO 200190663 | | 11/2001 |
| WO | WO 02/39033 | A1 | 5/2002 |
| WO | WO 03/021155 | A1 | 3/2003 |
| WO | WO 2006033782 | | 3/2006 |
| WO | WO 2007007576 | | 1/2007 |
| WO | WO 2007/023480 | A1 | 3/2007 |
| WO | WO 2008/037896 | A2 | 4/2008 |
| WO | WO 2008045086 | | 4/2008 |
| WO | WO 2008048252 | | 4/2008 |
| WO | WO 2009/094788 | A1 | 8/2009 |
| WO | WO 2010004716 | | 1/2010 |
| WO | WO 2010005918 | | 1/2010 |
| WO | WO 2010054498 | | 5/2010 |
| WO | WO 2010104709 | | 9/2010 |
| WO | WO 2011/004025 | A1 | 1/2011 |
| WO | WO 2012/016452 | A1 | 2/2012 |
| WO | WO 2013142760 | | 9/2013 |
| WO | WO 2013/189013 | A1 | 12/2013 |
| WO | WO 2014/004108 | A1 | 1/2014 |
| WO | WO 2014031559 | | 2/2014 |
| WO | WO 2014031708 | | 2/2014 |
| WO | WO 2014/115497 | A1 | 7/2014 |
| WO | WO 2015/027573 | A1 | 3/2015 |
| WO | WO 2015/188895 | A1 | 12/2015 |
| WO | WO 2016/105262 | A1 | 6/2016 |
| WO | WO 2016158092 | | 10/2016 |
| WO | WO 2016159152 | | 10/2016 |
| WO | WO 2017/065433 | A1 | 4/2017 |
| WO | 2017138820 | A1 | 8/2017 |
| WO | WO 2018/022503 | A1 | 2/2018 |
| WO | WO 2018/055826 | A1 | 3/2018 |
| WO | WO 2018135850 | | 7/2018 |
| WO | WO 2018/137125 | A1 | 8/2018 |
| WO | WO 2018/185220 | A2 | 10/2018 |
| WO | WO 2019/033610 | A1 | 2/2019 |
| WO | WO 2019/093575 | A1 | 5/2019 |
| WO | WO 2020067039 | | 4/2020 |
| WO | WO 2020158653 | | 8/2020 |
| WO | WO 2020179826 | | 9/2020 |
| WO | WO 2020/201820 | A1 | 10/2020 |
| WO | WO 2021050617 | | 3/2021 |
| WO | WO 2021050618 | | 3/2021 |
| WO | WO 2021050886 | | 3/2021 |
| WO | WO 2021054199 | | 3/2021 |
| WO | WO 2021106957 | | 6/2021 |
| WO | WO 2021125354 | | 6/2021 |
| WO | WO 2021/130834 | A1 | 7/2021 |
| WO | WO 2021172516 | | 9/2021 |
| WO | WO 2021215528 | | 10/2021 |
| WO | WO 2021234857 | | 11/2021 |
| WO | WO 2022064784 | | 3/2022 |
| WO | 2022168305 | A1 | 8/2022 |
| WO | WO 2022/262674 | A1 | 12/2022 |
| WO | WO 2023059724 | | 4/2023 |
| WO | WO 2023069273 | | 4/2023 |
| WO | WO 2023084127 | | 5/2023 |
| WO | WO 2023/096550 | A1 | 6/2023 |
| WO | WO 2023/130122 | A1 | 7/2023 |
| WO | WO 2023127329 | | 7/2023 |

(56) References Cited

FOREIGN PATENT DOCUMENTS

| | | | |
|---|---|---|---|
| WO | WO 2023127345 | | 7/2023 |
| WO | WO 2023140145 | | 7/2023 |
| WO | WO 2023157565 | | 8/2023 |
| WO | WO 2023157568 | | 8/2023 |
| WO | WO 2023161248 | | 8/2023 |
| WO | WO 2023161249 | | 8/2023 |
| WO | WO 2023/170671 | A1 | 9/2023 |
| WO | WO 2023/181326 | A1 | 9/2023 |
| WO | WO 2023/181337 | A1 | 9/2023 |
| WO | WO 2023/183576 | A1 | 9/2023 |
| WO | WO 2023/198223 | A1 | 10/2023 |
| WO | WO 2024/040144 | A1 | 2/2024 |
| WO | WO 2024/045097 | A1 | 3/2024 |
| WO | WO 2024/053236 | A1 | 3/2024 |
| WO | WO 2024/062606 | A1 | 3/2024 |
| WO | WO 2024/072105 | A1 | 4/2024 |
| WO | WO 2024/091867 | A2 | 5/2024 |
| WO | WO 2024/133883 | A1 | 6/2024 |
| WO | WO 2024/172223 | A1 | 8/2024 |
| WO | WO 2024/176132 | A1 | 8/2024 |
| WO | WO 2024/177788 | A1 | 8/2024 |
| WO | WO 2024/189944 | A1 | 9/2024 |
| WO | WO 2024/198359 | A1 | 10/2024 |
| WO | WO 2024/252882 | A1 | 12/2024 |
| WO | WO 2024/252884 | A1 | 12/2024 |
| WO | WO 2025/009355 | A1 | 1/2025 |
| WO | WO 2025/020403 | A1 | 1/2025 |
| WO | WO 2025/021080 | A1 | 1/2025 |

OTHER PUBLICATIONS

"Economized Vapor Injection (EVI) Compressors," Emerson Climate Technologies Application Engineering Bulletin AE4-1327 R2, Revised Sep. 2006 (9 pages).

"Enhanced Vapour Injection (EVI) for ZH*KVE Scroll Compressors," Emerson Climate Technologies—Technical Information, C7.4. 3/1107-0512/E, May 2012 (10 pages).

"Heat Pump Mechanics" http://www.geo4va.vt.edu/A3/A3.htm#A3sec3c (Accessed Apr. 20, 2011) (19 pages).

"Heat pumps in residential and commercial buildings" http://www.heatpumpcentre.org/en/aboutheatpumps/heatpumpsinresidential/Sidor/default.aspx (Accessed Apr. 20, 2011) (2 pages).

Amir Rafati et al., "Fault Detection and Efficiency Assessment for HVAC Systems Using Non-Intrusive Load Monitoring: A Review," Energies 15.1 (2022): 341. (16 pages).

Animesh Pal et al., "Environmental Assessment and Characteristics of Next Generation Refrigerants," Kyushu University Institutional Repository, (2018): 58-66. (10 pages).

B.P. Rasmussen et al., "Model-Driven System Identification of Transcritical Vapor Compression Systems," IEEE Transactions on Control Systems Technology, May 2005, pp. 444-451, vol. 13 (8 pages).

Ekaterina Vi Nogradova, "Economizers in Chiller Systems," Bachelor's Thesis, Mikkelin Ammattikorkeakoulu, Nov. 2012 (50 pages).

Haraldsson et al., "Measurement of Performance and Evaluation of a Heat Pump—with Scroll Compressor EVI and Economizer," Lunds Institute of Technology, 2006 (4 pages).

Honeywell, VFF1, VFF2, VFF3, VFF6 Resilient Seat Butterfly Valves with Flanged Connections Jan. 2013, p. 1, 1st column, last paragraph. (Year: 2013) (20 pages).

International Preliminary Report on Patentability issued in International Application No. PCT/US2013/033433 on Sep. 23, 2014 (7 Pages).

International Preliminary Report on Patentability issued in International Application No. PCT/US2021/020017 on Sep. 9, 2022 (7 Pages).

International Search Report and Written Opinion issued in International Application No. PCT/US2013/033433 on Aug. 9, 2013 (11 Pages).

International Search Report and Written Opinion issued in International Application No. PCT/US2021/020017 on May 19, 2021 (7 Pages).

J. Navarro-Esbri et al., "A vapour compression chiller fault detection technique based on adaptative algorithms. Application to online refrigerant leakage detection," International Journal of Refrigeration 29.5 (2006): 716-723. (8 pages).

John P. Elson et al., "Scroll Technology: An Overview of Past, Present and Future Developments," International Compressor Engineering Conference, 2008, Paper 1871 (9 pages).

Korean Intellectual Property Office, International Search Report in International Application No. PCT/US2009/049734 (Jan. 20, 2010) (2 pages).

Korean Intellectual Property Office, International Search Report in International Application No. PCT/US2010/026010 (Sep. 28, 2010) (2 pages).

Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).

Matthew Wiggins, Ph.D et al., "HVAC Fault Detection," ASHRAE Journal 54.2 (2012): 78-80. (3 pages).

Milan Jain et al., "Beyond control: Enabling smart thermostats for leakage detection," Proceedings of the ACM on Interactive, Mobile, Wearable and Ubiquitous Technologies 3.1 (2019): 1-21. (21 pages).

Murphy et al., "Air-Source Integrated Heat Pump for Net-Zero-Energy Houses Technology Status Report," Oak Ridge National Laboratory, ORNL-TM-2007-112 (Jul. 2007) (93 pages).

Murphy et al., "Ground-Source Integrated Heat Pump for Net-Zero-Energy Houses Technology Status Report," Oak Ridge National Laboratory, ORNL-TM-2007-177 (Dec. 2007) (78 pages).

Rohit Chintala et al., "Automated fault detection of residential air-conditioning systems using thermostat drive cycles," Energy and Buildings 236 (2021): 110691. (28 pages).

Shen Tian, et al., "A study on a real-time leak detection method for pressurized liquid refrigerant pipeline based on pressure and flow rate," Applied Thermal Engineering 95 (2016): 462-470. (17 pages).

Shunsuke Kimura, "Development of a Remote Refrigerant Leakage Detection System for VRFs and Chillers," Purdue University—International Refrigeration and Air Conditioning Conference Paper 2304, 2022. (10 pages).

Taras, Michael F., "Reheat Which Concept is Best," *ASHRAE Journal: 35-40* (Dec. 2004) (7 pages).

Third Party Submission dated Nov. 10, 2014 filed in U.S. Appl. No. 13/848,342 (13 Pages).

Tolga N. Aynur, "Variable Refrigerant Flow Systems: A Review, Energy and Buildings," Jan. 2010, pp. 1106-1112, vol. 42 (7 pages).

Wei Yang et al., "The Design Method of U-Bend Geothermal Heat Exchanger of DX-GCHP in Cooling Model," IEEE, 2011, pp. 3635-3637 (English Abstract) (3 pages).

Xudong Wang et al., "A2L Refrigerants Leaks and Ignitions Testing under Whole Room Scale," Purdue University—International Refrigeration and Air Conditioning Conference Paper 1849, 2018. (11 pages).

Taras, Michael F., "Comparison of Reheat Strategies for Constant Volume Rooftop Units", Carrier Corporation, Mar. 2008, 10p.

Baldini, Luca et al., "Decentralized cooling and dehumidification with a 3 stage LowEx heat exchanger for free reheating", Elsevier, Energy and Buildings, v76, Jun. 2014, pp. 270-277.

Bobelin, Damien et al., "Experimental Results of a Newly Developed Very High Temperature Industrial Heat Pump (140C) Equipped with Scroll Compressors and Working With a New Bland Refrigerant", Purdue University, Purdue e-Pubs, International Refrigeration and Air Conditioning Conference, School of Mechanical Engineering, 2012, 11p.

Han, Xing et al., "A novel system of the isothermal dehumidification in a room air-conditioner", Elsevier, Energy and Buildings, v57, 2013, pp. 14-19.

Mayhew, Baldwin, "Dehumidification using CHW Return Based Reheat", Decarb Healthcare, A Guidebook for Decarbonizing Healthcare, Sep. 30, 2023, 60p.

(56) References Cited

OTHER PUBLICATIONS

Johnson Controls, "Premier 25 Ton to 80 Ton Rooftop Units R-410A Start-Up and Operation Guide", Form No. 5881421-JSG-A-02222, issued Feb. 2, 2022, 170p.
U.S. Appl. No. 10/137,763, filed Nov. 27, 2018, Nobuya Nakagawa.
U.S. Appl. No. 10/316,981, filed Jun. 11, 2019, Shaun Michael Ward.
U.S. Appl. No. 10/571,135, filed Feb. 25, 2020, David Kreutzman.
U.S. Appl. No. 10/598,418, filed Mar. 24, 2020, Bo Shen.
U.S. Appl. No. 10/648,674, filed May 12, 2020, John Edward Boyd.
U.S. Appl. No. 10/718,549, filed Jul. 21, 2020, Rodney K. Pugh.
U.S. Appl. No. 10/895,387, filed Jan. 19, 2021, Raheel A. Chaudhry.
U.S. Appl. No. 11/480,366, filed Oct. 25, 2022, Efi Efraim Or.
U.S. Appl. No. 11/535,781, filed Dec. 27, 2022, Eiji Kumakura.
U.S. Appl. No. 11/579,636, filed Feb. 14, 2023, Kevin Doyle.
U.S. Appl. No. 11/592,215, filed Feb. 28, 2023, Robert R. Brown.
U.S. Appl. No. 11/608,998, filed Mar. 21, 2023, Udi Meirav.
U.S. Appl. No. 11/864,510, filed Jan. 9, 2024, Michael Sean Day.
U.S. Appl. No. 11/906,188, filed Feb. 20, 2024, Andrew Leroy Hjortland.
U.S. Appl. No. 12/065,016, filed Aug. 20, 2024, Junqi Dong.
U.S. Appl. No. 12/078,390, filed Sep. 3, 2024, Stephen Blake Pickle.
U.S. Appl. No. 12/117,202, filed Oct. 15, 2024, Michael Rigney.
U.S. Appl. No. 12/173,940, filed Dec. 24, 2024, David J. Lingrey.
Office Action issued in Canadian Application No. 3,169,461 dated Sep. 3, 2024 (5 pages).
"OpenADR Alliance—Overview," [online] [retrieved on Dec. 6, 2024] Retrieved from the Internet <ULR: https://web.archive.org/web/20120620015352/http://www.openadr.org/overview> (1 pages).
U.S. Non-Final Office Action issued in U.S. Appl. No. 17/186,779 dated Sep. 30, 2022 (16 pages).
U.S. Final Office Action issued in U.S. Appl. No. 17/186,779 dated Jun. 13, 2023 (16 pages).
U.S. Non-Final Office Action issued in U.S. Appl. No. 17/186,779 dated Jan. 3, 2024 (13 pages).
U.S. Final Office Action issued in U.S. Appl. No. 17/186,779 dated Oct. 4, 2024 (49 pages).
U.S. Non-Final Office Action issued in U.S. Appl. No. 17/186,779 dated Mar. 17, 2025 (18 pages).
U.S. Non-Final Office Action issued in U.S. Appl. No. 18/175,093 dated Aug. 28, 2024 (16 pages).
U.S. Notice of Allowance issued in U.S. Appl. No. 18/175,093 dated Jan. 31, 2025 (12 pages).
Taras, "Comparison of Reheat Strategies For Constant Volume Rooftop Unites", Mar. 2008 (10 pages).
Han et al., "A novel system of the isothermal dehumidification in a room air-conditioner", Energy and building 57, 2013, pp. 14-19 (6 pages).
Yuan et al., "The Review of the Application of the Heat Pipe on Enhancing Performance of the Air-Conditioning System in Buildings", Processes 11.11 (2023): 3081 (57 pages).
Williamson, R., Prototype Solar Heating and Cooling Systems Including Potable Hot Water (Quarterly reports) No. DOE/NASA/CR-150850. Solaron Corp., Dencer, Co (USA), 1978 (39 pages).
Yoshionaga et al., "Operational control methods for a parallel system combining ground source and sir source heat pumps in a warm region", sciencedirect.com. Journal of Building Engineering, Jun. 1, 2024, vol. 86, 108712 (9 pages).
"Intellidyne PTAC" Accessed Feb. 6, 2025 (1 page).
"Lateral Duct Accessory Kit for Use with Packages Terminal Air Conditioner Heat Pump", Accessed Feb. 7, 2025 (4 pages).
"Air Unit" Daikin Air Intelligence, Accessed Feb. 7, 2025 (168 pages).
"Multi-Positional Coils" durastar.com., Dec. 11, 2023 (4 pages).
Maple Air Heat Pump Water Heater (index.php) (6 pages).
Air-Conditioning, Heating, and Refrigeration Institute—Heat Pump Water Heaters (4 pages).
International Building Performance Simulation Association USA—What do I need to know in order to properly model heat pump water heaters? Jeff Maguire (3 pages).
Velasco et al., "Experimental characterization of the coupling and heating performance of a CO2 water-to-water heat pump and a water storage tank for domestic hot water production system", Energy and Buildings 265 (2022): 112085, pp. 1-19 (19 pages).
Shen et al., "Development and Validation of Quasi-Steady-State Heat Pump Water Heater Model Having Stratified Water Tank and Wrapped-Tank Condenser", International Journal of Refrigeration 87, 2018, pp. 78-90 (29 pages).
"Emerge™-x Air Source Heat Pump", hotwater.com. Feb. 26, 2024 (2 pages).
"Polestar E Series Commercial Heat Pump", shenlingglobal.com. Accessed: Feb. 27, 2025 (13 pages).
"Vertical Stack Water Source Heat Pumps", uniluxhvac.com/, Sep. 1, 2024 (1 page).
"Eco Series Fresh-Pak", firstco.co,, Aug. 2021 (16 pages).
"AIO All-In-One Heat Pump and ERV with No Outdoor Unit", cdn.flipbooklets.com (2025).
"Vertical Stack Hybrid Heat Pumps", www.johnsoncontrols.com, 2024 (4 pages).
"Custom ERU With Energy Wheel, Water Source Heat Pump & Hot Gas Reheat", https://xetex.com, Feb. 20, 2025, (5 pages).
"EC-Fit® with Energy Recovery Wheel", www.unitedcoolair.com, Accessed Mar. 31, 2025, (4 pages).
"Data center heat recovery and reuse", www.danfoss.com, Oct. 6, 2022 ( 5 pages).
"Air-To-Air Energy Recovery Equipment", www.ashrae.org, 2020, (38 pages).
"Commercial Heatsmart: Case Studies", sustainablewestchester.org, 2020 (10 pages).
"ITW GSE 3500 PCA", itwgse.com, Jul. 6, 2020 (10 pages).
KPI 2-way Energy Recovery Ventilation Unit (8 pages).
David et al., "Advances in multifunctional balanced ventilation technology for dwellings and arising challenges to quantify energy efficiency and renewable generation contributions using international test standards", Renewable and Sustainable Energy Reviews, 2020, pp. 1-12 (12 pages).
Bellocchi et al., "Reversible heat pump HVAC system with regenerative heat exchanger for electric vehicles: Analysis of its impact on driving range", Applied Thermal Engineering 129 2018, pp. 290-305 (48 pages).
Delima et al., High Efficiency Integrated Space Conditioning, Water heating and Air Distribution System for HUD-Code Manufactured Housing. Delima Associates, Sep. 30, 2008 (38 pages).
Shen et al., "Cold Climate Integrated Heat Pump", docs.lib.purdue.edu. International Refrigeration and Air Conditioning Conference. Paper 2466, 2022 (11 pages).
"YHM 16 SEER Modulating Heat Pump", york.com. Accessed: Mar. 25, 2025 (9 pages).
"Packages Products—Combined Heating & Cooling Systems", www.carrier.com, (1 page).
"1.5 Ton 13.4 SEER2 80% AFUE 45,000 BTU ACiQ Gas Furnace and Air Conditioner System—Upflow/Downflow", Multi-Positional, www.hvacdirect.com, (3 pages).
"Coolshift—Industrial Heat Pump Solutions", www.vitalis.ca, Accessed Jan. 8, 2025, (6 pages).
"Alpha Class Accelerating the Adoption of cleaner commercial heat pump technology", www.aaon.com, Accessed Jan. 8, 2025, (4 pages).
"Ascend Air-to-Water heat Pump", www.trane.com, May 28, 2022, (3 pages).
"Refrigeration Basics—Heat Pumps Part 1", www.refrigerationbasics.com, (5 pages).
Orr, Brian, "How a Heat Pump Reversing Valve Works", www.hvacschool.com, (16 pages).
"Components for heat pumps—part 5: four-way reversing valves", www.danfoss.com, Accessed: Apr. 6, 2025, (2 pages).
"Product Application Designing Air-Source Heat Pumps", Greenheck, 2024, (4 pages).

(56) References Cited

OTHER PUBLICATIONS

"Application Guide Supplement Modular Air-to-Water heat Pumps", Trane, Aug. 22, 2022, (28 pages).
"The Four-Way Valve: A Key Component in Reversible HVAC Systems", www.keyter.com, Accessed Apr. 6, 2025, (3 pages).
"Heat Pump Basics: How do Heat Pumps Work & What are Some Common Types?", www.superradiatorcoils.com, Posted by Super Radiator Coils on Aug. 24, 2021, 8:50:19 am, (8 pages).

* cited by examiner

INTEGRATED DEMAND WATER HEATING USING A CAPACITY MODULATED HEAT PUMP WITH DESUPERHEATER

CROSS-REFERENCE TO RELATED APPLICATIONS

This application is a continuation of U.S. patent application Ser. No. 18/175,203, filed Feb. 27, 2023, which is a continuation of U.S. patent application Ser. No. 16/539,956, filed on Aug. 13, 2019, which claims the benefit of U.S. Provisional Patent Application No. 62/724,459, filed on Aug. 29, 2018. All of these applications are incorporated by reference herein in their entirety.

TECHNICAL FIELD

This disclosure relates generally to heating, ventilation, and air conditioning systems including heat pump systems.

SUMMARY

A heat pump system is disclosed that provides at least six different modes of heating, cooling, and/or domestic water heating operation, where domestic water heating may occur concurrently with heating or cooling a space in a structure. The heat pump system may include (1) a desuperheater heat exchanger positioned downstream of the compressor and operable as a desuperheater, a condenser, or an evaporator, (2) a source heat exchanger operable as either a condenser or an evaporator, (3) a load heat exchanger operable as either a condenser or an evaporator, (4) a reversing valve positioned downstream of the desuperheater heat exchanger and configured to alternately direct refrigerant flow from the desuperheater heat exchanger to one of the load heat exchanger and the source heat exchanger and to alternately return refrigerant flow from the other of the load heat exchanger and the source heat exchanger to the compressor, and (5) an expansion valve positioned between the load heat exchanger and the source heat exchanger.

In one embodiment, a heat pump system is disclosed comprising a refrigerant circuit that fluidly interconnects: (1) a variable speed compressor; (2) a desuperheater heat exchanger positioned downstream of the compressor and operable as a desuperheater, a condenser, or an evaporator; (3) a source heat exchanger operable as either a condenser or an evaporator; (4) a load heat exchanger operable as either a condenser or an evaporator; (5) a reversing valve positioned downstream of the desuperheater heat exchanger and configured to alternately direct refrigerant flow from the desuperheater heat exchanger to one of the load heat exchanger and the source heat exchanger and to alternately return refrigerant flow from the other of the load heat exchanger and the source heat exchanger to the compressor; and (6) an expansion valve positioned between the load heat exchanger and the source heat exchanger.

In this embodiment, the load heat exchanger may be a refrigerant-to-liquid heat exchanger or a refrigerant-to-air heat exchanger. The heat pump system may include a fan driven by a variable speed motor, where the fan is configured to flow air over a portion of the load heat exchanger. The desuperheater heat exchanger may be a refrigerant-to-liquid heat exchanger configured to exchange heat between refrigerant in the refrigerant circuit and domestic water in a storage loop. The heat pump system may include a storage tank for storing heated domestic water, and a variable speed pump for circulating the domestic water in the storage loop and through the desuperheater heat exchanger. The source heat exchanger may be a refrigerant-to-liquid heat exchanger configured to exchange heat between refrigerant in the refrigerant circuit and a liquid in a source loop. The heat pump system may include a variable speed pump for circulating the liquid in the source loop and through the source heat exchanger. The expansion valve may be an electronically controlled thermostatic expansion valve.

In this embodiment, the heat pump system may include a controller comprising a processor and memory on which one or more software programs are stored, the controller configured to control operation of the reversing valve, the expansion valve, the compressor, a first variable speed pump for circulating water through the desuperheater heat exchanger, and a second variable speed pump for circulating a source liquid through the source heat exchanger.

To operate the system in a space heating mode, the controller may be configured to: (a) control the first variable speed pump to disable heat exchange in the desuperheater heat exchanger; (b) control the reversing valve to cause refrigerant flow from the desuperheater heat exchanger to the load heat exchanger acting as a condenser and to return flow from the source heat exchanger acting as an evaporator to the compressor; (c) control an opening in the expansion valve to cause refrigerant flow from the load heat exchanger, through the expansion valve, and to the source heat exchanger; and (d) control the second variable speed pump to To operate the system in a space cooling mode, the controller may be configured to: (a) control the first variable speed pump to disable heat exchange in the desuperheater heat exchanger; (b) control the reversing valve to cause refrigerant flow from the desuperheater heat exchanger to the source heat exchanger acting as a condenser and to return flow from the load heat exchanger acting as an evaporator to the compressor; (c) control an opening in the expansion valve to cause refrigerant flow from the source heat exchanger, through the expansion valve, and to the load heat exchanger; and (d) control the second variable speed pump to enable heat exchange in the source heat exchanger.

To operate the system in a space heating with desuperheater water heating mode, the controller may be configured to: (a) control the first variable speed pump to enable heat exchange in the desuperheater heat exchanger to heat domestic water pumped through the desuperheater heat exchanger at a relatively low flow rate; (b) control the reversing valve to cause refrigerant flow from the desuperheater heat exchanger to the load heat exchanger acting as a condenser and to return flow from the source heat exchanger acting as an evaporator to the compressor, wherein the refrigerant flow from the desuperheater heat exchanger comprises desuperheated refrigerant; (c) control an opening in the expansion valve to cause refrigerant flow from the load heat exchanger, through the expansion valve, and to the source heat exchanger; and (d) control the second variable speed pump to enable heat exchange in the source heat exchanger.

To operate the system in a space cooling with desuperheater water heating mode, the controller may be configured to: (a) control the first variable speed pump to enable heat exchange in the desuperheater heat exchanger to heat domestic water pumped through the desuperheater heat exchanger at a relatively low flow rate; (b) control the reversing valve to cause refrigerant flow from the desuperheater heat exchanger to the source heat exchanger acting as a condenser and to return flow from the load heat exchanger acting as an evaporator to the compressor, wherein the refrigerant flow from the desuperheater heat exchanger comprises desuperheated refrigerant; (c) control an opening in the expansion valve to cause refrigerant flow from the source heat exchanger, through the expansion valve, and to the load heat exchanger; and (d) control the second variable speed pump to enable heat exchange in the source heat exchanger.

To operate the system in a space cooling to water heating mode, the controller may be configured to: (a) control the first variable speed pump to enable heat exchange in the desuperheater heat exchanger to heat domestic water pumped through the desuperheater heat exchanger at a relatively high flow rate; (b) control the reversing valve to cause refrigerant flow from the desuperheater heat exchanger acting as a condenser to the source heat exchanger configured in an inactive state and to return flow from the load heat exchanger acting as an evaporator to the compressor; (c) control an opening in the expansion valve to cause refrigerant flow from the source heat exchanger, through the expansion valve, and to the load heat exchanger; and (d) control the second variable speed pump to disable heat exchange in the source heat exchanger. In this mode, the load heat exchanger may be a refrigerant-to-air heat exchanger, and the controller may be configured to control a variable speed motor to drive a fan to flow air over a portion of the load heat exchanger.

To operate the system in a water heating mode, the controller may be configured to: (a) control the first variable speed pump to enable heat exchange in the desuperheater heat exchanger to heat domestic water pumped through the desuperheater heat exchanger at a relatively high flow rate; (b) control the reversing valve to cause refrigerant flow from the desuperheater heat exchanger acting as a condenser to the load heat exchanger configured in an inactive state and to return flow from the source heat exchanger acting as an evaporator to the compressor; (c) control an opening in the expansion valve to cause refrigerant flow from the load heat exchanger, through the expansion valve, and to the source heat exchanger; and (d) control the second variable speed pump to enable heat exchange in the source heat exchanger.

In another embodiment, a heat pump system is disclosed, comprising a refrigerant circuit that fluidly interconnects: (1) a variable speed compressor; (2) a desuperheater heat exchanger positioned downstream of the compressor and operable as a desuperheater, a condenser, or an evaporator; (3) a source heat exchanger operable as either a condenser or an evaporator; (4) a load heat exchanger operable as either a condenser or an evaporator; (5) a reversing valve positioned downstream of the desuperheater heat exchanger and configured to alternately direct refrigerant flow from the desuperheater heat exchanger to one of the load heat exchanger and the source heat exchanger and to alternately return refrigerant flow from the other of the load heat exchanger and the source heat exchanger to the compressor; and (6) an expansion valve positioned between the load heat exchanger and the source heat exchanger. The heat pump system is operable in any of at least: (a) a space heating mode in which the desuperheater heat exchanger is configured in an inactive state, (b) a space cooling mode in which the desuperheater heat exchanger is configured in an inactive state, (c) a space heating with concurrent desuperheater water heating mode in which refrigerant flow from the desuperheater heat exchanger comprises desuperheated refrigerant, (d) a space cooling with concurrent desuperheater water heating mode in which refrigerant flow from the desuperheater heat exchanger comprises desuperheated refrigerant, (e) a space cooling to water heating mode in which refrigerant flow from the desuperheater heat exchanger comprises condensed refrigerant, the load heat exchanger is configured in an active state, and the source heat exchanger is configured in an inactive state, and (f) a dedicated water heating mode in which refrigerant flow from the desuperheater heat exchanger comprises condensed refrigerant, the load heat exchanger is configured in an inactive state and the source heat exchanger is configured in an active state.

In another embodiment, a method for operating a heat pump system is disclosed, comprising: (1) providing a refrigerant circuit that fluidly interconnects: (a) a variable speed compressor, (b) a desuperheater heat exchanger positioned downstream of the compressor and operable as a desuperheater, a condenser, or an evaporator, (c) a source heat exchanger operable as either a condenser or an evaporator, (d) a load heat exchanger operable as either a condenser or an evaporator, (e) a reversing valve positioned downstream of the desuperheater heat exchanger and configured to alternately direct refrigerant flow from the desuperheater heat exchanger to one of the load heat exchanger and the source heat exchanger and to alternately return refrigerant flow from the other of the load heat exchanger and the source heat exchanger to the compressor, and (f) an expansion valve positioned between the load heat exchanger and the source heat exchanger; (2) providing a controller comprising a processor and memory on which one or more software programs are stored; and (3) operating the controller to control operation of the reversing valve, the expansion valve, the compressor, a first variable speed pump for circulating domestic water through the desuperheater heat exchanger, and a second variable speed pump for circulating a liquid through the source heat exchanger.

To operate the heat pump system in a space heating mode may include: (i) controlling the first variable speed pump to disable heat exchange in the desuperheater heat exchanger; (ii) controlling the reversing valve to cause refrigerant flow from the desuperheater heat exchanger to the load heat exchanger acting as a condenser and to return flow from the source heat exchanger acting as an evaporator to the compressor; (iii) controlling an opening in the expansion valve to cause refrigerant flow from the load heat exchanger, through the expansion valve, and to the source heat exchanger; and (iv) controlling the second variable speed pump to enable heat exchange in the source heat exchanger.

To operate the heat pump system in a space cooling mode may include: (i) controlling the first variable speed pump to disable heat exchange in the desuperheater heat exchanger; (ii) controlling the reversing valve to cause refrigerant flow from the desuperheater heat exchanger to the source heat exchanger acting as a condenser and to return flow from the load heat exchanger acting as an evaporator to the compressor; (iii) controlling an opening in the expansion valve to cause refrigerant flow from the source heat exchanger, through the expansion valve, and to the load heat exchanger; and (iv) controlling the second variable speed pump to enable heat exchange in the source heat exchanger.

To operate the heat pump system in a space heating with desuperheater water heating mode may include: (i) controlling the first variable speed pump to enable heat exchange in the desuperheater heat exchanger to heat domestic water pumped through the desuperheater heat exchanger at a relatively low flow rate; (ii) controlling the reversing valve to cause refrigerant flow from the desuperheater heat exchanger to the load heat exchanger acting as a condenser and to return flow from the source heat exchanger acting as an evaporator to the compressor, wherein the refrigerant flow from the desuperheater heat exchanger comprises desuperheated refrigerant; (iii) controlling an opening in the expansion valve to cause refrigerant flow from the load heat exchanger, through the expansion valve, and to the source heat exchanger; and (iv) controlling the second variable speed pump to enable heat exchange in the source heat exchanger.

To operate the heat pump system in a space cooling with desuperheater water heating mode may include: (i) controlling the first variable speed pump to enable heat exchange in the desuperheater heat exchanger to heat domestic water pumped through the desuperheater heat exchanger at a relatively low flow rate; (ii) controlling the reversing valve to cause refrigerant flow from the desuperheater heat exchanger to the source heat exchanger acting as a condenser and to return flow from the load heat exchanger acting as an evaporator to the compressor, wherein the refrigerant flow from the desuperheater heat exchanger comprises desuperheated refrigerant; (iii) controlling an opening in the expansion valve to cause refrigerant flow from the source heat exchanger, through the expansion valve, and to the load heat exchanger; and (iv) controlling the second variable speed pump to enable heat exchange in the source heat exchanger.

To operate the heat pump system in a space cooling to water heating mode may include: (i) controlling the first variable speed pump to enable heat exchange in the desuperheater heat exchanger to heat domestic water pumped through the desuperheater heat exchanger at a relatively high flow rate; (ii) controlling the reversing valve to cause refrigerant flow from the desuperheater heat exchanger acting as a condenser to the source heat exchanger configured in an inactive state and to return flow from the load heat exchanger acting as an evaporator to the compressor; (iii) controlling an opening in the expansion valve to cause refrigerant flow from the source heat exchanger, through the expansion valve, and to the load heat exchanger; and (iv) controlling the second variable speed pump to disable heat exchange in the source heat exchanger. In this mode, the heat pump system may be configured to include controlling a variable speed motor to drive a fan to flow air over a portion of the load heat exchanger.

To operate the heat pump system in a water heating mode may include: (i) controlling the first variable speed pump to enable heat exchange in the desuperheater heat exchanger to heat domestic water pumped through the desuperheater heat exchanger at a relatively high flow rate; (ii) controlling the reversing valve to cause refrigerant flow from the desuperheater heat exchanger acting as a condenser to the load heat exchanger configured in an inactive state and to return flow from the source heat exchanger acting as an evaporator to the compressor; (iii) controlling an opening in the expansion valve to cause refrigerant flow from the load heat exchanger, through the expansion valve, and to the source heat exchanger; and (iv) controlling the second variable speed pump to enable heat exchange in the source heat exchanger.

BRIEF DESCRIPTION OF THE DRAWINGS

For a better understanding of the features described in this disclosure, reference may be made to embodiments shown in the drawings. The components in the drawings are not necessarily to scale, and related elements may be omitted so as to emphasize and clearly illustrate the novel features described herein. In addition, system components can be variously arranged, as known in the art. In the figures, like referenced numerals may refer to like parts throughout the different figures unless otherwise specified.

DETAILED DESCRIPTION

Figure 1:
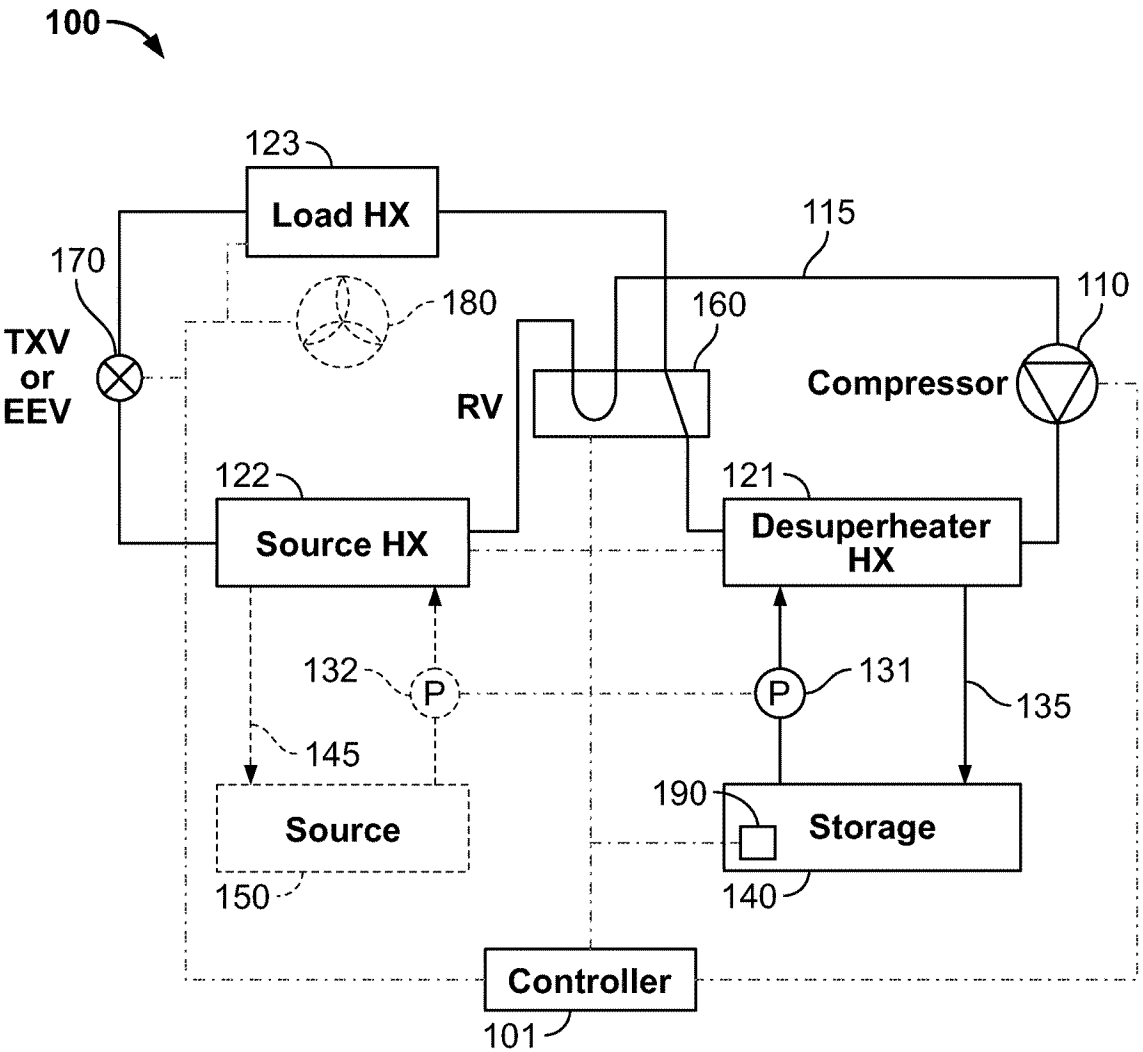
FIG. 1 is a schematic of a heat pump system according to the instant disclosure.

While the features, methods, devices, and systems described herein may be embodied in various forms, there are shown in the drawings, and will hereinafter be described, some exemplary and non-limiting embodiments. Not all of the depicted components described in this disclosure may be required, however, and some implementations may include additional, different, or fewer components from those expressly described in this disclosure. Variations in the arrangement and type of the components may be made without departing from the spirit or scope of the claims as set forth herein.

A heat pump system including a desuperheater is disclosed for providing the heating, cooling, and water heating needs for a structure. The heat pump system described herein includes embodiments designed to minimize the number of components. For example, the heat pump system disclosed herein utilizes a single expansion valve in place of a combination of expansion valves, check valves, and/or receiver to increase the efficiency of the system. In some embodiments, the system may include one or more fans, blowers, or air handlers for circulating heated or cooled air produced by the heat pump system throughout the structure. In some embodiments, the system may include auxiliary heater(s) for satisfying any additional heating needs. For example, an auxiliary heater may be included in a storage tank or connected to storage tank plumbing and configured to provide auxiliary heating to water stored in the storage tank according to some embodiments.

The heat pump system of the instant disclosure provides at least six modes of operation: (1) space heating, (2) space cooling, (3) space heating with desuperheater water heating, (4) space cooling with desuperheater water heating, (5) space cooling to water heating, and (6) dedicated water heating. The heat pump system of the instant disclosure eliminates the need to isolate the third, unused heat exchanger in any given mode of operation, which eliminates the possibility of refrigerant accumulating in the unused, third heat exchanger. The refrigerant in the heat pump system of the instant disclosure may include any known refrigerant, such as R410A or R32, or any later-developed type of refrigerant.

Use of a variable speed compressor as disclosed herein allows appropriate capacity for domestic water heating and space conditioning. For example, although demand may call for the heat pump system to require a 1-ton compressor, the heat pump of the instant disclosure allows the use of a 4-5 ton compressor, for example, that is driven at a low speed to match the demand. Conversely, if demand requires a 4-5 ton compressor, for example, then the heat pump system will have the capacity to meet that demand.

Use of one or more variable speed fan motors as disclosed herein allows appropriate airflow for capacity modulation. Use of one or more variable speed pumps as disclosed herein allows more appropriate water/fluid flow for capacity modulation. In addition, by varying the rate of water flowing through a desuperheater heat exchanger, the heat pump system can control whether the unit desuperheats or fully condenses the refrigerant. The desuperheater heat exchanger may be sized and/or configured to fully condense the refrigerant when desired.

Turning to the drawings, FIG. 1 illustrates an embodiment of a heat pump system 100 of the instant disclosure. In this embodiment, heat pump system 100 includes variable speed compressor 110, desuperheater heat exchanger 121 for heating domestic water, reversing valve 160, source heat exchanger 122, expansion valve 170 comprising either a mechanical thermostatic expansion valve (TXV) or an electronically controlled thermostatic expansion valve (EEV), and load heat exchanger 123 for heating or cooling a space. Each of these components are fluidly connected to one another by vapor compression refrigerant circuit 115 comprising one or more fluid conduits through which refrigerant is conveyed to/from these components according to the processes described herein.

Heat pump system 100 may also include controller 101, which may be functionally connected to one or more of the foregoing components (as well as other components not shown) to control the operation, position, or function of one or more features of one or more of these components. For example, controller 101 may control the direction of flow and the flowrate of refrigerant in refrigerant circuit 115 according to an operational mode of heat pump system 100 as well as the heating and cooling demand on heat pump system 100.

In some embodiments, desuperheater, source, and load heat exchangers 121,122,123 may each be configured as refrigerant-to-liquid heat exchangers. In other embodiments, only desuperheater and source heat exchangers 121,122 are configured as refrigerant-to-liquid heat exchangers. In still other embodiments, only desuperheater heat exchanger 121 is configured as a refrigerant-to-liquid heat exchanger. In such embodiments, these heat exchangers may be configured as coaxial heat exchangers, brazed plate heat exchangers, or any type of heat exchanger capable of exchanging heat between two adjacent fluids.

In some embodiments, source heat exchanger 122 and/or load heat exchanger 123 may be configured as a refrigerant-to-air heat exchanger. If source heat exchanger 122 and/or load heat exchanger 123 is a refrigerant-to-air heat exchanger, heat pump system 100 may also include one or more fans or blowers 180 powered by respective variable speed fan motors to convey air across the coils of the respective source and/or load heat exchangers 122,123 to exchange heat with the refrigerant in the refrigerant circuit, which air may thereafter be circulated throughout a space or structure to provide for heating and/or cooling needs. If load heat exchanger 123, for example, is a refrigerant-to-liquid heat exchanger, then heat pump system 100 may be configured to include a load loop (not shown) configured to circulate a liquid therein to exchange heat with the refrigerant in the load heat exchanger 123. The load loop may include a variable speed pump for circulating a liquid through the load loop.

As shown in the embodiment of FIG. 1, heat pump system 100 includes storage loop 135 connecting desuperheater heat exchanger 121 to storage tank 140, and source loop 145 connecting source heat exchanger 122 to source 150 if source heat exchanger 122 is a refrigerant-to-liquid heat exchanger. Source 150 may be configured to act as a heat sink or heat source and may include any type of source suitable for use with a heat pump system. In some embodiments, source 150 is a geothermal source, such as a body of water or the Earth.

Storage loop 135 and source loop 145 may each comprise one or more fluid conduits configured to convey a fluid, such as water, therethrough for exchanging heat with the refrigerant flowing through refrigerant circuit 115 via desuperheater heat exchanger 121 and source heat exchanger 122, respectively. For example, in various embodiments, desuperheater heat exchanger 121, when activated, is configured to exchange heat between the refrigerant circulating in refrigerant circuit 115 and water circulating in storage loop 135 to create hot water that may be stored in storage tank 140. Similarly, in various embodiments, source heat exchanger 122, when activated, is configured to exchange heat between the refrigerant circulating in refrigerant circuit 115 and water or other liquid circulating in source loop 145. In embodiments in which source heat exchanger 122 is a refrigerant-to-air heat exchanger, then source loop 145 may be omitted and replaced with a fan 180 driven by a variable speed motor. In some embodiments, the fluid circulating through source loop 145 may be an antifreeze. The flow rate of water circulating through storage loop 135 may be controlled by controller 101 by controlling variable speed pump 131. Similarly, the flow rate of water, antifreeze or other liquid circulating through source loop 145 may be controlled by controller 101 by controlling variable speed pump 132.

Storage tank 140 may further include one or more temperature sensors 190 for detecting the temperature of water stored in storage tank 140. Although FIG. 1 illustrates the one or more temperature sensors 190 being included as part of the storage tank 140, the one or more temperature sensors 190 may alternatively be located at any other location along storage loop 135 to detect the temperature of water circulating through storage loop 135. In addition, to enable the controller 101 to precisely monitor and adjust performance of heat pump system 100, one or more temperature sensors 190, one or more pressure sensors 191, one or more flow rate sensors 192, one or more voltage sensors, and one or more current sensors may be positioned anywhere on heat pump system 100, including along refrigerant circuit 115, along source loop 145, along the load loop (if present), along storage loop 135, near the inlet and/or discharge ports of the desuperheater, source, and load heat exchangers, 121,122, 123, on or near the suction end and discharge end of compressor 110, upstream, downstream and/or on expansion valve 170, and on or near any motor and pump.

Some or all of the components of heat pump system 100 may be installed within the structure in which air conditioning, heating, or hot water is desired. In some embodiments, some components, such as one or more portions of source loop 145, may be installed outdoors.

Various operating modes of heat pump system 100 are shown in FIGS. 2 through 7, where source heat exchanger 122 is shown for illustration purposes as being a refrigerant-to-liquid heat exchanger. As described herein, however, source heat exchanger 122 may alternatively be configured as a refrigerant-to-air heat exchanger with a fan 180 positioned in proximity thereto to flow air over source heat exchanger 122 to exchange heat with the refrigerant circulating through refrigerant circuit 115.

At least one of the operating modes may be initiated automatically by controller 101 when the temperature of the water stored in storage tank 140 falls below a predetermined value. At least some of the various operating modes may be initiated automatically by controller 101 in response to a call for heating or cooling, for example, by one or more thermostats 195 according to predetermined user settings, or in response to a call for heating or cooling requested by a user operating the thermostat or by a user selectable input at a user interface that enables a user to select an operational mode of heat pump system 100. The one or more thermostats 195 may be any known or later developed device for detecting a temperature in a space and for triggering a call for heating or cooling of the space. For example, in one embodiment, the thermostat may be a mechanical, mercury-style thermostat. In another embodiment, the thermostat may be an electric, thermistor-style thermostat. The one or more thermostats 195 may be electronically programmable by a user via a user interface. The user interface may be a touch screen, which may be detachable from the thermostat. The user interface may be associated with a user's web-enabled device, including a mobile phone, a tablet, a smart watch, and a personal computer, operating a web application that remotely interfaces with the one or more thermostats 195 and/or controller 101. In this way, a user may remotely access, program, and/or control the thermostat and/or controller 101. The one or more thermostats 195 may include a smart thermostat that is connected to the Internet and capable of learning user behaviors and patterns for automatically adjusting operational settings of the thermostat or controller 101. The one or more thermostats 195 may be connected to controller 101 by wire, or may alternatively be wirelessly connected to controller 101 via Wi-Fi, Bluetooth, or any other wireless protocol.

Figure 2:
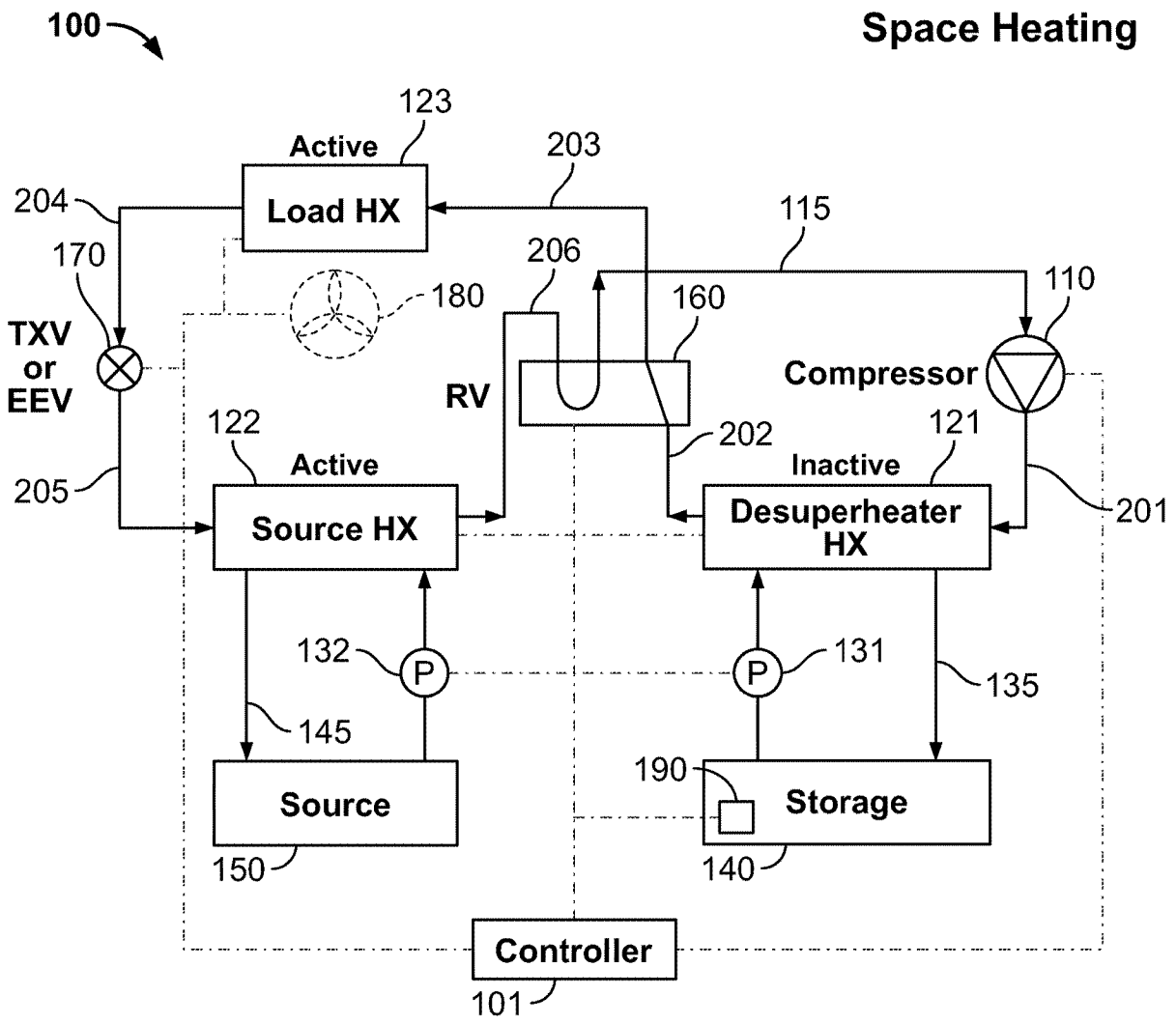
FIG. 2 is a schematic illustrating a first operational mode of the heat pump system illustrated in FIG. 1.

FIG. 2 illustrates heat pump system 100 configured in a space heating mode for heating air in a space or a structure, such as a home or office. In this mode, desuperheater heat exchanger 121 is inactive, and load heat exchanger 123 and source heat exchanger 122 are both active.

At 201, hot, compressed refrigerant gas leaving compressor 110 is conveyed through inactive desuperheater heat exchanger 121 (i.e., storage loop 135 is inactive). At 202, the hot, compressed refrigerant gas is conveyed to reversing valve 160 (reversing valve 160 is powered off), where the refrigerant is then conveyed to load heat exchanger 123.

At 203, the hot, compressed refrigerant gas enters load heat exchanger 123 acting as a condenser to cause the refrigerant to condense to a liquid. If load heat exchanger 123 is a refrigerant-to-liquid heat exchanger, such as a coaxial heat exchanger, then the compressed refrigerant gas may exchange heat with relatively cooler liquid flowing through a load loop (not shown). If load heat exchanger 123 is an air coil heat exchanger, air flowing over the coils of load heat exchanger 123 may cool the compressed refrigerant gas flowing in the coils. As the heated refrigerant gas is cooled, heat is concurrently released from the refrigerant and absorbed by the air as it passes over the coils of load heat exchanger 123, and the heated air may then be utilized to heat a space within the structure.

At 204, liquid refrigerant (at relatively high pressure) exits load heat exchanger 123 and is conveyed to expansion valve 170. Expansion valve 170 separates high and low pressure refrigerant and meters the refrigerant as a liquid for entry to the source heat exchanger 122.

At 205, the metered liquid refrigerant is conveyed to source heat exchanger 122 acting as an evaporator to vaporize the refrigerant by exchanging heat with the relatively warmer source liquid from source loop 145.

At 206, refrigerant gas is conveyed to reversing valve 160 (powered off), which diverts the refrigerant gas back to compressor 110 to continue the cycle.

Figure 3:
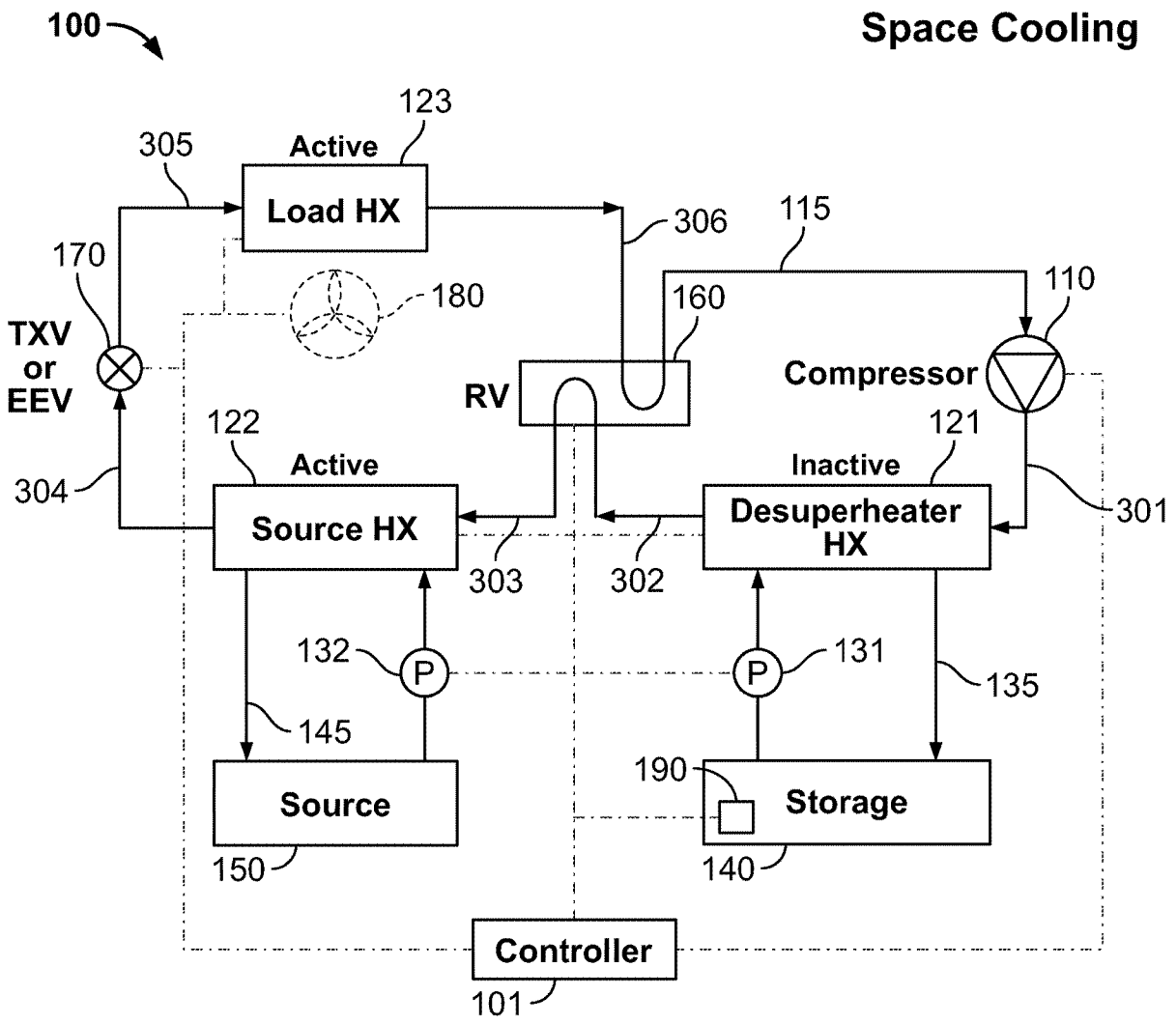
FIG. 3 is a schematic illustrating a second operational mode of the heat pump system illustrated in FIG. 1.

FIG. 3 illustrates heat pump system 100 configured in a space cooling mode for cooling air in a space or a structure, such as a home or office. In this mode, desuperheater heat exchanger 121 is inactive, and load heat exchanger 123 and source heat exchanger 122 are both active.

At 301, hot, compressed refrigerant gas leaving compressor 110 is conveyed through inactive desuperheater heat exchanger 121 (i.e., storage loop 135 is inactive). At 302, the hot, compressed refrigerant gas is conveyed to reversing valve 160 (reversing valve 160 is powered on), where the refrigerant is then conveyed to source heat exchanger 122.

At 303, the hot, compressed refrigerant gas enters source heat exchanger 122 acting as a condenser to cause the refrigerant to condense to a liquid by exchanging heat with the relatively cooler source liquid from source loop 145.

At 304, liquid refrigerant (at relatively high pressure) exits source heat exchanger 122 and is conveyed to expansion valve 170. Expansion valve 170 separates high and low pressure refrigerant and meters the refrigerant as a liquid for entry to the load heat exchanger 123.

At 305, the metered liquid refrigerant is conveyed to load heat exchanger 123 acting as an evaporator to vaporize the refrigerant by exchanging heat with the relatively warmer load liquid from load loop (not shown) or by the relatively warmer air being blown over the coils of load heat exchanger 123 if load heat exchanger 123 is an air coil heat exchanger. In the latter case, for example, as the liquid refrigerant absorbs heat from the air flowing over the coils of load heat exchanger 123, the air flowing over the coils of load heat exchanger 123 by fan 180 becomes cooled and the refrigerant changes phase to become a vapor. The structure may then be cooled as fan 180 blows the cooled air through a duct system that distributes the cooled air to one or more spaces within the structure to be cooled.

At 306, refrigerant gas is conveyed to reversing valve 160 (powered on), which diverts the refrigerant gas back to compressor 110 to continue the cycle.

Figure 4:
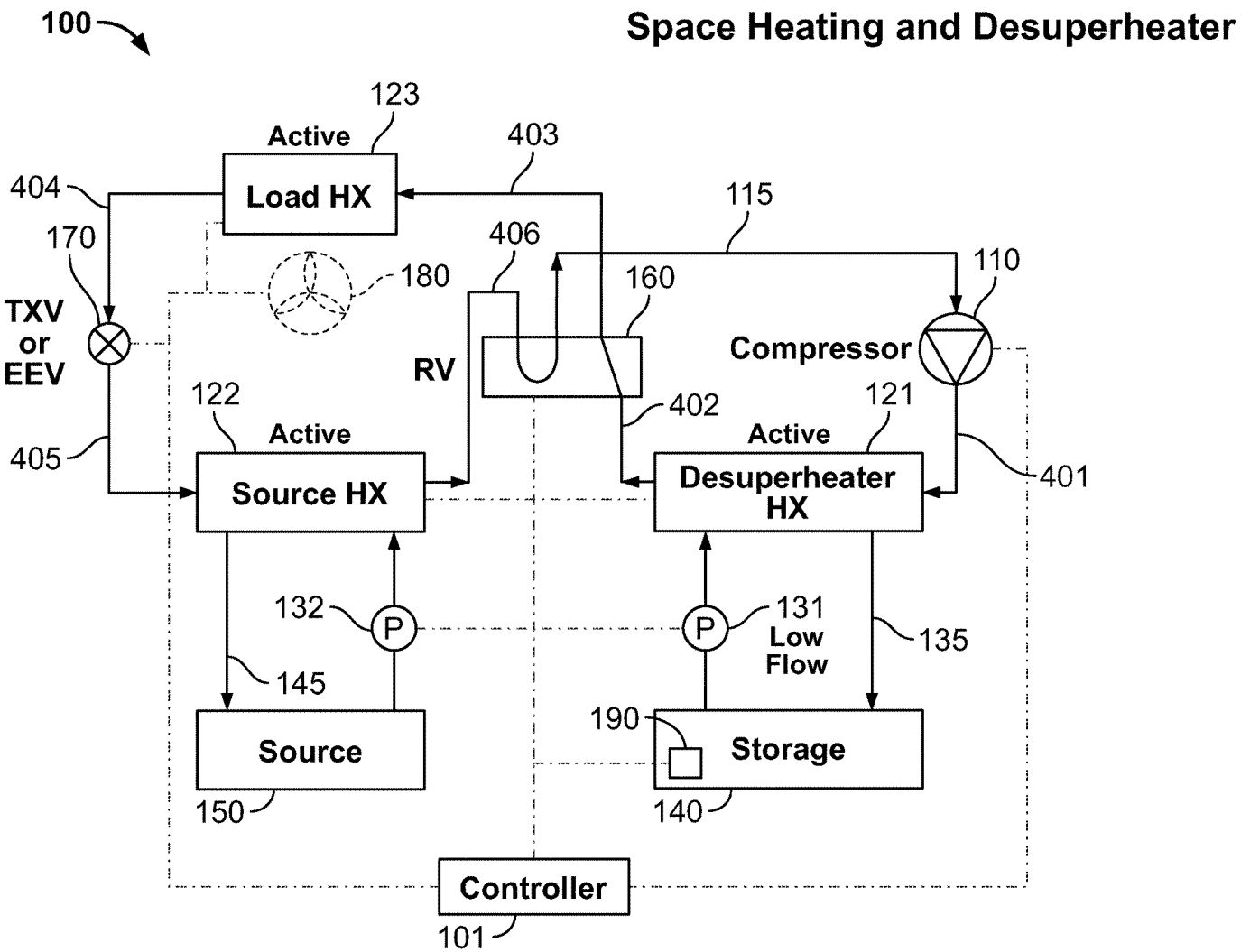
FIG. 4 is a schematic illustrating a third operational mode of the heat pump system illustrated in FIG. 1.

FIG. 4 illustrates heat pump system 100 configured in a space heating with desuperheater water heating mode for (1) heating air in a space or a structure, such as a home or office, and for (2) desuperheater domestic water heating. In this mode, desuperheater heat exchanger 121, load heat exchanger 123, and source heat exchanger 122 are all active, and domestic water heating occurs concurrently with space heating.

At 401, hot, compressed refrigerant gas leaving compressor 110 is conveyed through active desuperheater heat exchanger 121 where relatively low water flow is allowed to flow through storage loop 135 by controlling the speed of pump 131. The refrigerant is desuperheated by exchanging heat with the relatively cooler water flowing at a relatively low rate through the storage loop 135.

At 402, the desuperheated refrigerant gas is conveyed to reversing valve 160 (reversing valve 160 is powered off), where the refrigerant is then conveyed to load heat exchanger 123.

At 403, the desuperheated refrigerant gas enters load heat exchanger 123 acting as a condenser to cause the refrigerant to condense to a liquid. If load heat exchanger 123 is a refrigerant-to-liquid heat exchanger, such as a coaxial heat exchanger, then the refrigerant gas may exchange heat with relatively cooler liquid flowing through load loop (not shown). If load heat exchanger 123 is an air coil heat exchanger, air flowing over the coils of load heat exchanger 123 may cool the desuperheated refrigerant gas flowing in the coils. As the desuperheated refrigerant gas is cooled, heat is concurrently released from the refrigerant and absorbed by the air as it passes over the coils of load heat exchanger 123, and the heated air may then be utilized to heat a space within the structure.

At 404, liquid refrigerant (at relatively high pressure) exits load heat exchanger 123 and is conveyed to expansion valve 170. Expansion valve 170 separates high and low pressure refrigerant and meters the refrigerant as a liquid for entry to the source heat exchanger 122.

At 405, the metered liquid refrigerant is conveyed to source heat exchanger 122 acting as an evaporator to vaporize the refrigerant by exchanging heat with the relatively warmer source liquid from source loop 145.

At 406, refrigerant gas is conveyed to reversing valve 160 (powered off), which diverts the refrigerant gas back to compressor 110 to continue the cycle.

Figure 5:
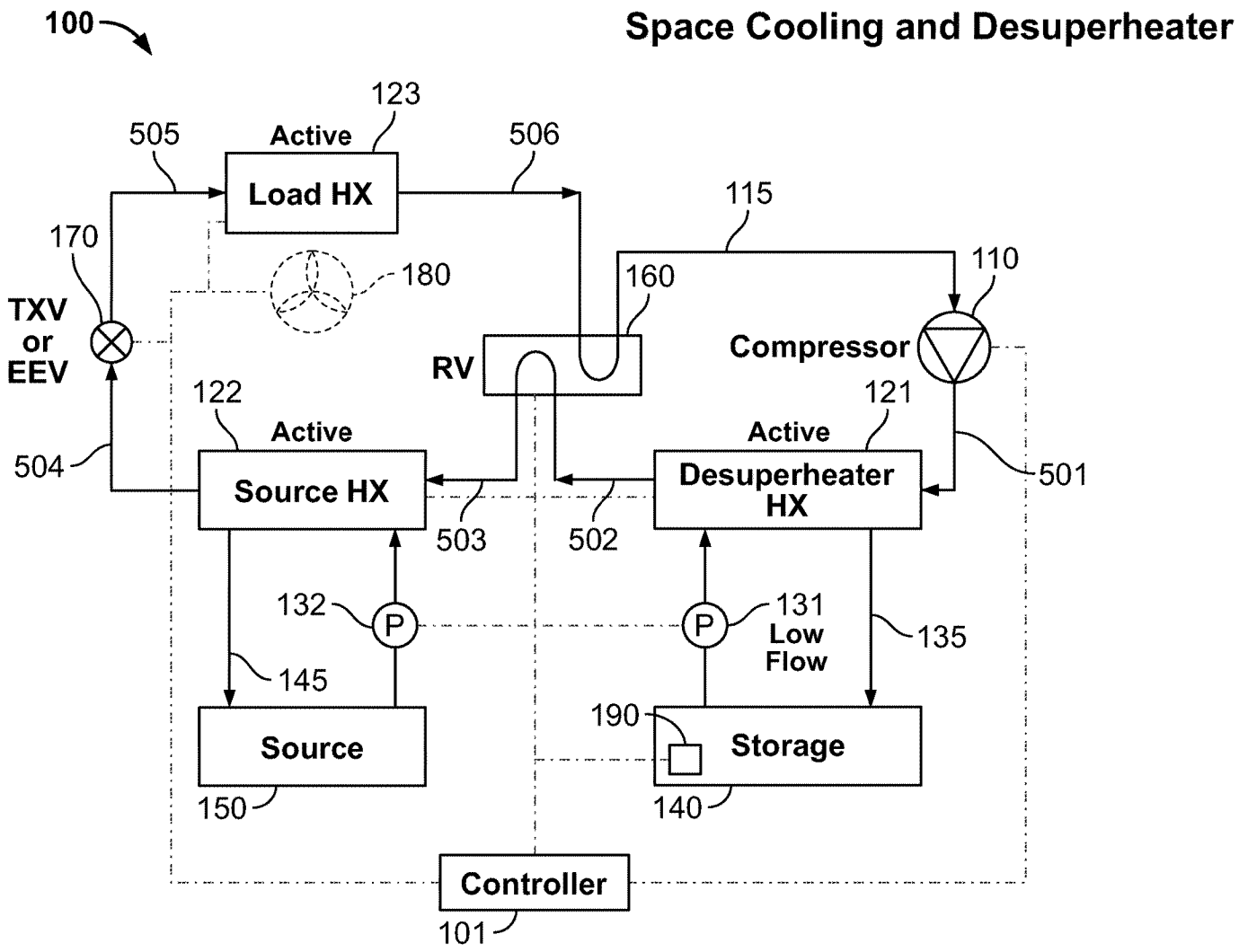
FIG. 5 is a schematic illustrating a fourth operational mode of the heat pump system illustrated in FIG. 1.

FIG. 5 illustrates heat pump system 100 configured in a space cooling with desuperheater water heating mode for (1) cooling air in a space or a structure, such as a home or office, and for (2) desuperheater domestic water heating. In this mode, desuperheater heat exchanger 121, load heat exchanger 123, and source heat exchanger 122 are all active, and domestic waterer heating occurs concurrently with space cooling.

At 501, hot, compressed refrigerant gas leaving compressor 110 is conveyed through active desuperheater heat exchanger where relatively low water flow is allowed to flow through storage loop 135 by controlling the speed of pump 131. The refrigerant is desuperheated by exchanging heat with the relatively cooler water flowing at a relatively low rate through the storage loop 135.

At 502, the desuperheated refrigerant gas is conveyed to reversing valve 160 (reversing valve 160 is powered on), where the refrigerant is then conveyed to source heat exchanger 122.

At 503, the desuperheated refrigerant gas enters source heat exchanger 122 acting as a condenser to cause the refrigerant to condense to a liquid by exchanging heat with the relatively cooler source liquid from source loop 145.

At 504, liquid refrigerant (at relatively high pressure) exits source heat exchanger 122 and is conveyed to expansion valve 170. Expansion valve 170 separates high and low pressure refrigerant and meters the refrigerant as a liquid for entry to the load heat exchanger 123.

At 505, the metered liquid refrigerant is conveyed to load heat exchanger 123 acting as an evaporator to vaporize the refrigerant by exchanging heat with the relatively warmer load liquid from load loop (not shown) or by the relatively warmer air being blown over the coils of load heat exchanger 123 if load heat exchanger 123 is an air coil heat exchanger. In the latter case, for example, as the liquid refrigerant absorbs heat from the air flowing over the coils of load heat exchanger 123, the air flowing over the coils of load heat exchanger 123 by fan 180 becomes cooled and the refrigerant changes phase to become a vapor. The structure may then be cooled as fan 180 blows the cooled air through a duct system that distributes the cooled air to one or more spaces within the structure to be cooled.

At 506, refrigerant gas is conveyed to reversing valve 160 (powered on), which diverts the refrigerant gas back to compressor 110 to continue the cycle.

Figure 6:
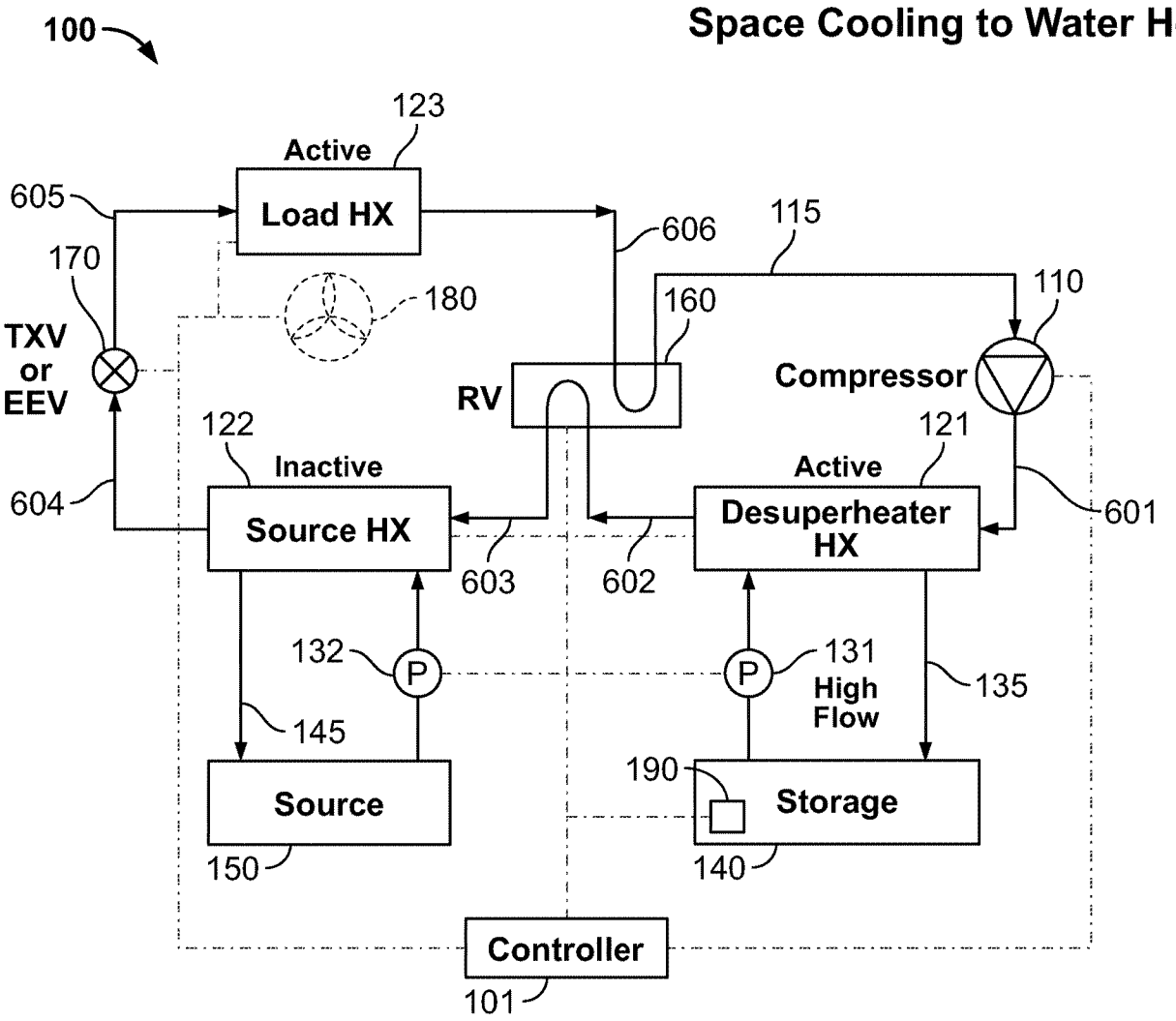
FIG. 6 is a schematic illustrating a fifth operational mode of the heat pump system illustrated in FIG. 1.

FIG. 6 illustrates heat pump system 100 configured in a space cooling to water heating mode for (1) cooling air in a space or a structure, such as a home or office, and for (2) domestic water heating. In this mode, desuperheater heat exchanger 121 and load heat exchanger 123 are active, while the source heat exchanger 122 is inactive. In addition, a substantial amount of domestic water heating occurs concurrently with space cooling.

At 601, hot, compressed refrigerant gas leaving compressor 110 is conveyed through active desuperheater heat exchanger 121 acting as a condenser, where relatively high water flow is allowed to flow through storage loop 135 by controlling the speed of pump 131. The refrigerant is condensed to a liquid by desuperheater heat exchanger 121 by exchanging heat with the relatively cooler water flowing at a relatively high rate through the storage loop 135. In turn, the water flowing through storage loop 135 may gain a substantial amount of heat when traversing through desuperheater heat exchanger 121. The heated water may be stored and/or circulated through storage tank 140.

At 602, the liquid refrigerant is conveyed to reversing valve 160 (reversing valve 160 is powered on), where the refrigerant is then conveyed to source heat exchanger 122.

At 603, the liquid refrigerant (at relatively high pressure) is conveyed through inactive source heat exchanger 122 (i.e., source loop 145 is inactive), and at 604 is conveyed to expansion valve 170. Expansion valve 170 separates high and low pressure refrigerant and meters the refrigerant as a liquid for entry to the load heat exchanger 123.

At 605, the metered liquid refrigerant is conveyed to load heat exchanger 123 acting as an evaporator to vaporize the refrigerant by exchanging heat with the relatively warmer load liquid from load loop (not shown) or by the relatively warmer air being blown over the coils of load heat exchanger 123 if load heat exchanger 123 is an air coil heat exchanger. In the latter case, for example, as the liquid refrigerant absorbs heat from the air flowing over the coils of load heat exchanger 123, the air flowing over the coils of load heat exchanger 123 by fan 180 becomes cooled and the refrigerant changes phase to become a vapor. The structure may then be cooled as fan 180 blows the cooled air through a duct system that distributes the cooled air to one or more spaces within the structure to be cooled.

At 606, refrigerant gas is conveyed to reversing valve 160 (powered on), which diverts the refrigerant gas back to compressor 110 to continue the cycle.

Figure 7:
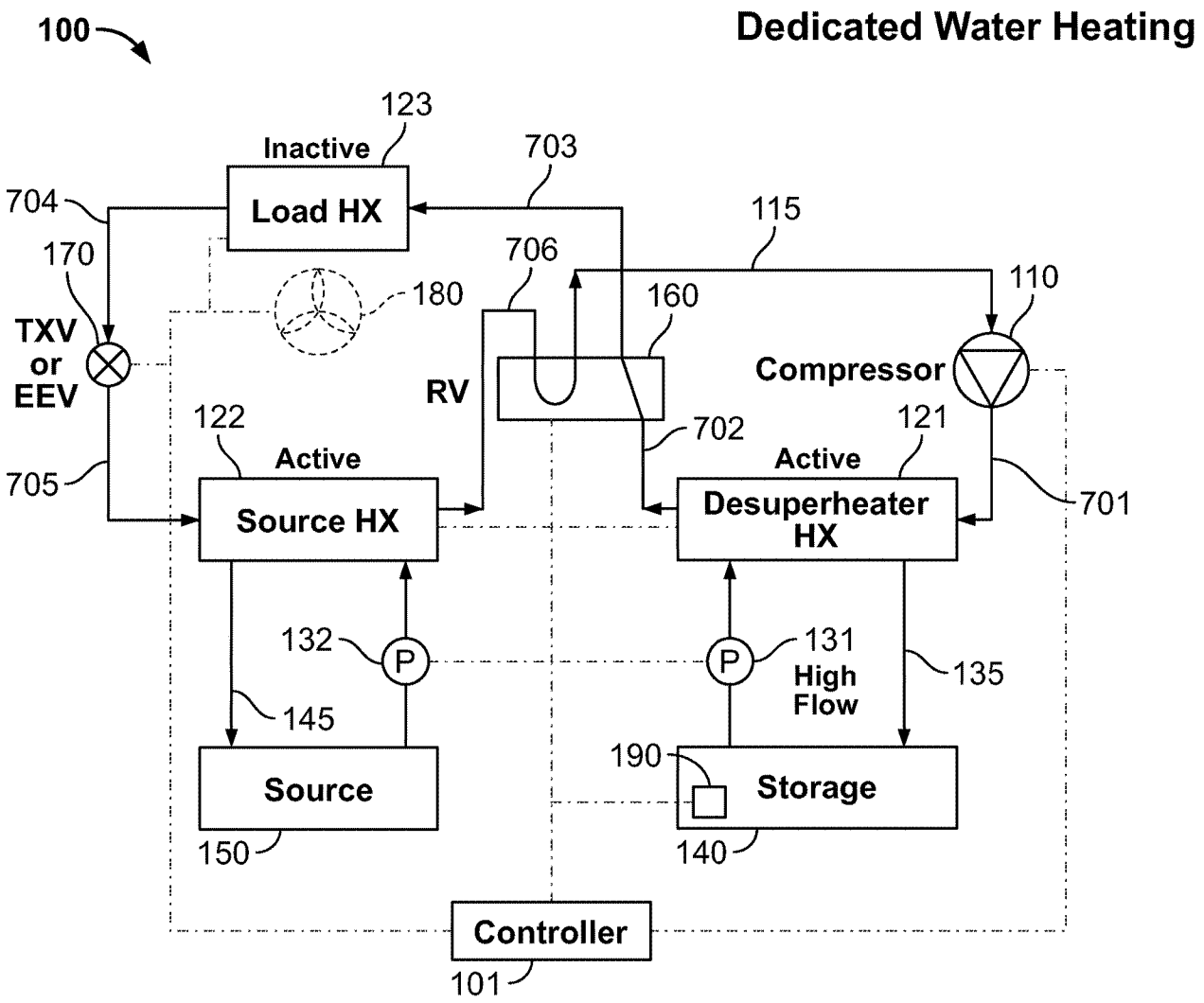
FIG. 7 is a schematic illustrating a sixth operational mode of the heat pump system illustrated in FIG. 1.

FIG. 7 illustrates heat pump system 100 configured in a dedicated water heating mode. In this mode, desuperheater heat exchanger 121 and source heat exchanger 122 are active, while the load heat exchanger 123 is inactive to provide a substantial amount of domestic water heating when space heating or cooling is not needed or when hot water demand exceeds the need for space conditioning.

At 701, hot, compressed refrigerant gas leaving compressor 110 is conveyed through active desuperheater heat exchanger 121 acting as a condenser, where relatively high water flow is allowed to flow through storage loop 135 by controlling the speed of pump 131. The refrigerant is condensed to a liquid by desuperheater heat exchanger 121 by exchanging heat with the relatively cooler water flowing at a relatively high rate through the storage loop 135. In turn, the water flowing through storage loop 135 may gain a substantial amount of heat when traversing through desuperheater heat exchanger 121. The heated water may be stored and/or circulated through storage tank 140.

At 702, the liquid refrigerant (at relatively high pressure) is conveyed to reversing valve 160 (reversing valve 160 is powered off). At 703, the liquid refrigerant is then conveyed to inactive load heat exchanger 123 (i.e., load loop (not shown) is inactive if load heat exchanger 123 is a refrigerant-to-liquid heat exchanger, and fan 180 is inactive if load heat exchanger 123 is a refrigerant-to-air heat exchanger).

At 704, liquid refrigerant (at relatively high pressure) exits load heat exchanger 123 and is conveyed to expansion valve 170. Expansion valve 170 separates high and low pressure refrigerant and meters the refrigerant as a liquid for entry to the load heat exchanger 123.

At 705, the metered liquid refrigerant is conveyed to source heat exchanger 122 acting as an evaporator to vaporize the refrigerant by exchanging heat with the relatively warmer source liquid from source loop 145.

At 706, refrigerant gas is conveyed to reversing valve 160 (powered off), which diverts the refrigerant gas back to compressor 110 to continue the cycle.

Figure 8:
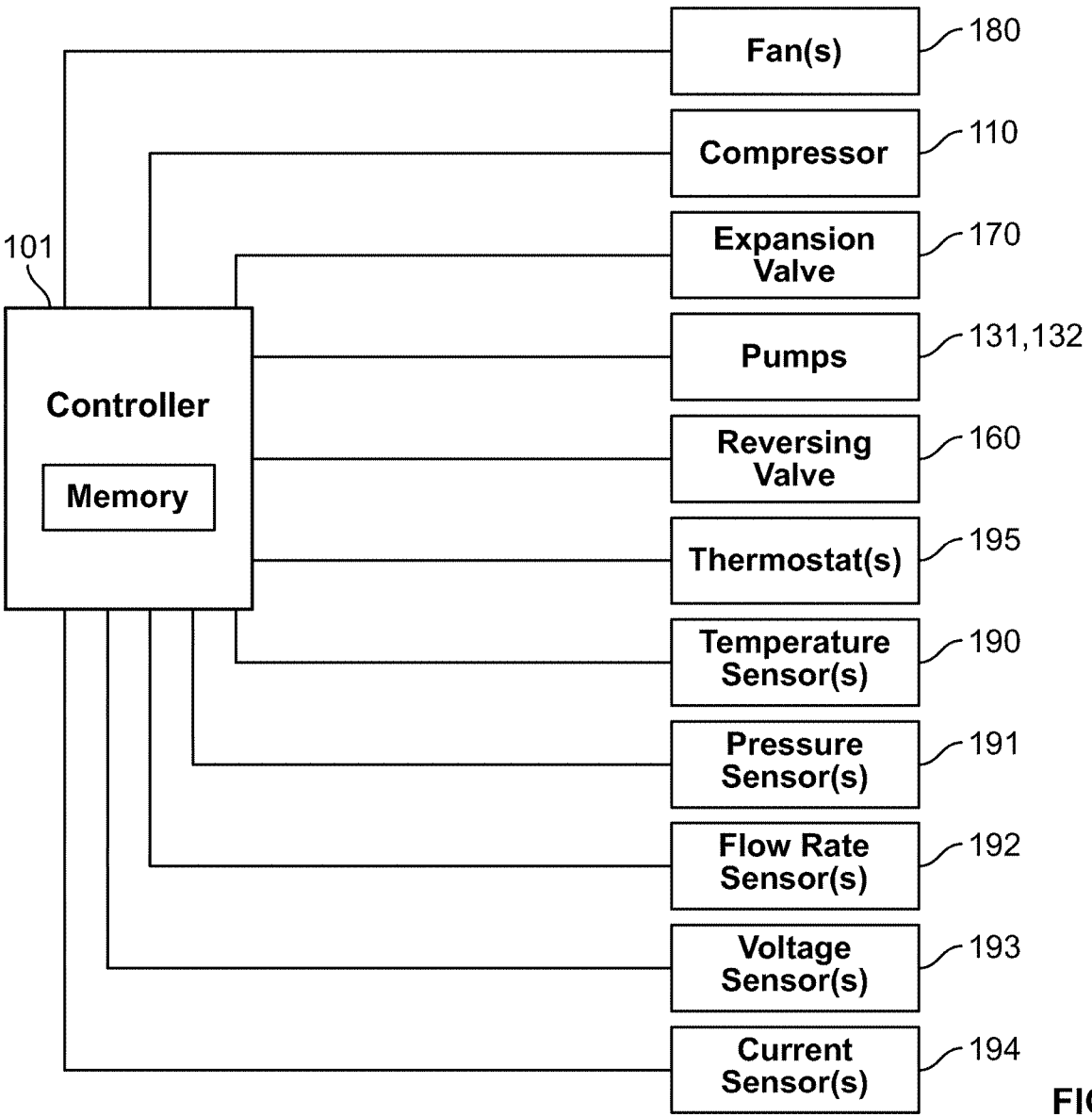
FIG. 8 is a schematic illustrating representative components of the heat pump system illustrated in FIG. 1 connected to a controller.

FIG. 8 illustrates an exemplary schematic illustrating representative components of heat pump system 100 that may be controlled by controller 101. Controller 101 may include a processor in communication with memory, wherein the memory stores a set of instructions that may be executed by the processor to cause the processor of the controller 101 to perform any one or more of the methods, processes or computer-based functions disclosed herein. For example, the controller 101 may cause one or more components of the heat pump system 100 to operate according to any one or more of the operational modes described herein.

In embodiments in which one or more fans 180 are included in the heat pump system, controller 101 may be configured to (wired or wirelessly) communicate with the one or more fans 180 (including each of the fans in a fan array) to control (1) an on/off state of the fan motor, and (2) the speed of the motor that drives the respective fan. Controlling the speed of the motor, and thus the amount of air passed over the coils of the source heat exchanger 122 and/or load heat exchanger 123 (if such heat exchangers are configured as refrigerant-to-air heat exchangers) by one or more fans 180, will control the amount of heat exchange that occurs in these heat exchangers. A variable frequency drive (VFD) may be coupled to each motor that drives the one or more fans 180. The VFD may be configured to drive the motor at any one of a number of different frequencies, including but not limited to line voltage frequency, to control the speed at which the motor operates to cause the amount of heat exchange in the source and/or load heat exchangers 122,123 to match the demand placed on heat pump system 100. In other embodiments, the motor is driven by a PWM signal according to a predetermined duty cycle to control the speed of the motor that drives the one or more fans 180.

Controller 101 may be configured to (wired or wirelessly) communicate with compressor 110 to control (1) the on/off operational state of the compressor 110, and (2) the speed at which compressor 110 operates to compress refrigerant according to the demand placed on heat pump system 100 and the operational mode of heat pump system 100. A variable frequency drive (VFD) may be coupled to compressor 110 to drive the compressor at any one of a number of different frequencies, including but not limited to line voltage frequency, to control the speed at which compressor 110 operates to match the demand placed on heat pump system 100. In other embodiments, the compressor is driven by a PWM signal according to a predetermined duty cycle to control the speed of the compressor 110.

Controller 101 may be configured to (wired or wirelessly) communicate with expansion valve 170 to precisely control the size of the orifice through which refrigerant flows in refrigerant circuit 115. Controller 101 may send and receive signals to and from a motor connected to expansion valve 170 to precisely open and close a refrigerant discharge port of expansion valve 170 and to report the position of the motor and/or valve to controller 170.

Controller 101 may be configured to (wired or wirelessly) communicate with variable speed pumps 131,132 to control the rate at which the pumps cause water and/or liquid to flow in storage loop 135 and source loop 145, respectively. Variable speed pumps 131,132 may be driven by a PWM signal according to a predetermined duty cycle to control the speed of the pumps 131,132 and therefore the discharge flow rate of these pumps.

Controller 101 may be configured to (wired or wirelessly) communicate with reversing valve 160 to control the direction of refrigerant flow in refrigerant circuit 115.

Controller 101 may be configured to (wired or wirelessly) communicate with the one or more thermostats 195 (e.g., an outdoor thermostat and/or one or more indoor thermostats for temperature controlled zones) for (1) detecting temperature differences between an outdoor temperature and an indoor temperature, and (2) for processing calls for space heating, space cooling, and/or water heating according to preprogrammed settings or manual, on-the-fly settings received from a user.

Controller 101 may be configured to (wired or wirelessly) communicate with the one or more temperature sensors 190 for detecting and processing the temperature at any one or more desired locations along refrigeration circuit 115, at any one or more desired locations along storage loop 135 including the temperature of water in the storage tank 140, at any one or more desired locations along source loop 145 including the temperature of liquid, for example, of source 150, and at any one or more desired locations along load loop (not shown).

Controller 101 may be configured to (wired or wirelessly) communicate with the one or more pressure sensors 191 for detecting and processing the static pressure at any one or more desired locations along refrigeration circuit 115.

Controller 101 may be configured to (wired or wirelessly) communicate with the one or more flow rate sensors 192 for detecting and processing the flow rate of water or other liquid along storage loop 135 and/or along source loop 145.

Controller 101 may be configured to (wired or wirelessly) communicate with the one or more voltage sensors 193 for detecting and processing the voltage across any electrical device that consumes electrical energy in heat pump system 100. For example, one or more voltage sensors may be deployed to detect the voltage provided to compressor 110, pumps 131,132, reversing valve 160, motor that drives expansion valve 170, and the one or more motors that drive the one or more fans 180.

Controller 101 may be configured to (wired or wirelessly) communicate with the one or more current sensors 194 for detecting and processing the current drawn by any device in heat pump system 100 that consumes electrical energy. For example, one or more current sensors may be deployed to detect the current drawn by compressor 110, pumps 131, 132, reversing valve 160, motor that drives expansion valve 170, and the one or more motors that drive the one or more fans 180.

Heat pump system 100 is capable of matching the space heating, space cooling, and water heating demand by controlling the components of heat pump system 100 anywhere in the range of about 0% capacity to about 100% capacity of such components of heat pump system 100. For example, if controller 101 determines that the heat pump system 100 must deliver 23% of the capacity of compressor 110 to meet a given space conditioning (i.e., space heating or space cooling) demand, then the controller 101 may command the compressor 110 to function at 23% of its capacity.

Simultaneous water heating may also be provided by heat pump system 100. For example, controller 101 may be configured to use excess capacity of the compressor 110 by driving the compressor 110 to, for example, 33% of its capacity to provide 23% of its capacity to meet space conditioning (i.e., space heating or space cooling) needs and to provide 10% of its capacity to simultaneously meet the demand for domestic water heating. The compressor 110 may be called upon to run longer to provide the 10% domestic water heating. Heat pump system 100 enables space conditioning (i.e., space heating or space cooling) and simultaneous domestic water heating by continuously putting at least some heat energy into domestic water circulating through desuperheater heat exchanger 121.

If domestic water heating demand is high, heat pump system 100 can adjust the amount of water flowing through storage loop 135 to force full condensing of the refrigerant exiting the desuperheater heat exchanger 121. When fully condensing the refrigerant in this way, the condensed refrigerant may be evaporated by load heat exchanger 123 to provide space cooling concurrently with high volume domestic water heating (as shown in FIG. 6), or evaporated by source heat exchanger 122 to simply provide high volume domestic water heating alone (as shown in FIG. 7).

Any process descriptions or blocks in the figures, should be understood as representing modules, segments, or portions of code which include one or more executable instructions for implementing specific logical functions or steps in the process, and alternate implementations are included within the scope of the embodiments described herein, in which functions may be executed out of order from that shown or discussed, including substantially concurrently or in reverse order, depending on the functionality involved, as would be understood by those having ordinary skill in the art.

The embodiments described herein are possible examples of implementations and are merely set forth for a clear understanding of the principles of the features described herein. Many variations and modifications may be made to the above-described embodiment(s) without substantially departing from the spirit and principles of the techniques, processes, devices, and systems described herein. All such modifications are intended to be included herein within the scope of this disclosure and protected by the following claims.

What is claimed is:

1. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein in the space cooling mode, the controller is configured to control the reversing valve to convey the refrigerant from the first port to the fourth port and from the third port to the second port to cause the refrigerant to:

flow to the refrigerant-to-liquid source heat exchanger configured as a condenser; and subsequently flow to the refrigerant-to-air load heat exchanger configured as an evaporator; and wherein in the space cooling mode, the controller is configured to control:

the first variable speed pump to disable heat exchange in the desuperheater heat exchanger while the refrigerant is conveyed through the desuperheater heat exchanger; and the second variable speed pump to enable the heat exchange in the refrigerant-to-liquid source heat exchanger.

2. The heat pump system of claim 1, further including a motor and a fan, wherein the fan is driven by the motor and is configured to flow the air over a portion of the refrigerant-to-air load heat exchanger.

3. The heat pump system of claim 1, wherein the first variable speed pump is configured to adjust an amount of flow of the domestic water through the desuperheater heat exchanger to modulate a heat exchange between the refrigerant and the domestic water.

4. The heat pump system of claim 1, wherein the desuperheater heat exchanger has an active state and an inactive state, and wherein all of the refrigerant is conveyed through the desuperheater heat exchanger regardless of whether the desuperheater heat exchanger is in the active state or the inactive state.

5. The heat pump system of claim 1, further comprising an expansion valve positioned between the refrigerant-to-liquid source heat exchanger and the refrigerant-to-air load heat exchanger.

6. The heat pump system of claim 5, wherein the controller is configured to control a size of an opening of the expansion valve to meter a flow of the refrigerant between the refrigerant-to-liquid source heat exchanger and the refrigerant-to-air load heat exchanger to further selectively operate in one of the plurality of operating modes.

7. The heat pump system of claim 1, wherein the controller is configured to control the first variable speed pump via a first pulse width modulation (PWM) signal to control a discharge flowrate of the first variable speed pump.

8. The heat pump system of claim 1, wherein the controller is configured to control the second variable speed pump via a second pulse width modulation (PWM) signal to control a discharge flowrate of the second variable speed pump.

9. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein the plurality of operating modes includes a space cooling with desuperheater water heating mode in which the controller is configured to control the reversing valve to convey the refrigerant from the first port to the fourth port and from the third port to the second port to cause the refrigerant to:

flow from the desuperheater heat exchanger to the refrigerant-to-liquid source heat exchanger acting as a condenser; and return from the refrigerant-to-air load heat exchanger acting as an evaporator to the compressor; and wherein in the space cooling with desuperheater water heating mode, the controller is configured to control:

the first variable speed pump to enable heat exchange in the desuperheater heat exchanger to heat the domestic water pumped through the desuperheater heat exchanger; and the second variable speed pump to enable the heat exchange in the refrigerant-to-liquid source heat exchanger.

10. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein the plurality of operating modes includes a space cooling to water heating mode in which the controller is configured to control the reversing valve to convey the refrigerant from the first port to the fourth port and from the third port to the second port to cause the refrigerant to:

flow from the desuperheater heat exchanger acting as a condenser to the refrigerant-to-liquid source heat exchanger; and return from the refrigerant-to-air load heat exchanger acting as an evaporator to the compressor; and wherein in the space cooling to water heating mode, the controller is configured to control:

the first variable speed pump to enable heat exchange in the desuperheater heat exchanger to heat the domestic water pumped through the desuperheater heat exchanger; and the second variable speed pump to disable the heat exchange in the refrigerant-to-liquid source heat exchanger.

11. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein the plurality of operating modes includes a water heating mode in which the controller is configured to control the reversing valve to convey the refrigerant from the first port to the third port and from the fourth port to the second port to cause the refrigerant to:

flow from the desuperheater heat exchanger acting as a condenser to the refrigerant-to-air load heat exchanger; and return flow from the refrigerant-to-liquid source heat exchanger acting as an evaporator to the compressor; and wherein in the water heating mode, the controller is configured to control:

the first variable speed pump to enable heat exchange in the desuperheater heat exchanger to heat the domestic water pumped through the desuperheater heat exchanger;

the second variable speed pump to enable the heat exchange in the refrigerant-to-liquid source heat exchanger; and the refrigerant-to-air load heat exchanger to be inactive.

12. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein in the space heating mode, the controller is configured to control the reversing valve to convey the refrigerant from the first port to the third port and from the fourth port to the second port to cause the refrigerant to:

flow to the refrigerant-to-air load heat exchanger configured as a condenser; and subsequently flow to the refrigerant-to-liquid source heat exchanger configured as an evaporator;

wherein in the space heating mode, the controller is configured to control:

the first variable speed pump to disable heat exchange in the desuperheater heat exchanger while the refrigerant is conveyed through the desuperheater heat exchanger; and the second variable speed pump to enable the heat exchange in the refrigerant-to-liquid source heat exchanger.

13. A heat pump system for conditioning air for use in a space, comprising:

a desuperheater heat exchanger operable as a desuperheater or a condenser;

a first variable speed pump positioned between a water storage tank and the desuperheater heat exchanger to circulate domestic water through the desuperheater heat exchanger; and a compressor configured to circulate a refrigerant, wherein the compressor is positioned upstream of the desuperheater heat exchanger through which all of the refrigerant is conveyed;

a refrigerant-to-liquid source heat exchanger operable as either a condenser or an evaporator to exchange heat between the refrigerant and a heat exchange liquid;

a second variable speed pump positioned between a source and the refrigerant-to-liquid source heat exchanger to circulate the heat exchange liquid through the refrigerant-to-liquid source heat exchanger;

a refrigerant-to-air load heat exchanger operable as either a condenser or an evaporator to exchange heat between the refrigerant and the air to condition the air for use in the space;

a reversing valve including a first port connected to the desuperheater heat exchanger, a second port connected to the compressor, a third port connected to the refrigerant-to-air load heat exchanger, and a fourth port connected to the refrigerant-to-liquid source heat exchanger; and a controller comprising a processor and memory and configured to:

control the first variable speed pump to control operation of the desuperheater heat exchanger;

control the second variable speed pump and the reversing valve to control operation of the refrigerant-to-liquid source heat exchanger and the refrigerant-to-air load heat exchanger; and selectively operate in one of a plurality of operating modes including a space cooling mode to cool the air for use in the space and a space heating mode to heat the air for use in the space by controlling operation of the desuperheater heat exchanger, the refrigerant-to-liquid source heat exchanger, and the refrigerant-to-air load heat exchanger;

wherein the plurality of operating modes includes a space heating with desuperheater water heating mode in which the controller is configured to control the reversing valve to convey the refrigerant from the first port to the third port and from the fourth port to the second port to cause the refrigerant to:

flow from the desuperheater heat exchanger to the refrigerant-to-air load heat exchanger acting as a condenser; and return from the refrigerant-to-liquid source heat exchanger acting as an evaporator to the compressor; and wherein in the space heating with desuperheater water heating mode, the controller is configured to control:

the first variable speed pump to enable heat exchange in the desuperheater heat exchanger to heat the domestic water pumped through the desuperheater heat exchanger; and the second variable speed pump to enable the heat exchange in the refrigerant-to-liquid source heat exchanger.

* * * * *